United States Patent [19]

Knudsen

[11] Patent Number: 4,907,392

[45] **Date of Patent: * Mar. 13, 1990**

[54] MACHINE FOR APPLYING TWIST-TYPE TIES

[75] Inventor: David S. Knudsen, St. Louis, Mo.

[73] Assignees: Peter S. Miravalle, St. Louis, Mo.; A. D. Lummus, Plano, Tex. ; a part interest

[ * ] Notice: The portion of the term of this patent subsequent to Mar. 15, 2005 has been disclaimed.

[21] Appl. No.: 161,119

[22] Filed: Feb. 26, 1988

Related U.S. Application Data

[63] Continuation of Ser. No. 881,730, Jul. 3, 1986, Pat. No. 4,730,434.

[51] Int. Cl.[4] ..... B65B 51/08

[52] U.S. Cl. ..... 53/138 A; 53/370; 83/382; 83/578

[58] Field of Search ..... 53/138 A, 135, 370, 53/372, 583; 83/382, 578

[56] References Cited

U.S. PATENT DOCUMENTS

| | | | |
|---|---|---|---|
| 3,138,904 | 6/1964 | Burford | 53/135 |
| 3,919,829 | 11/1975 | Burford | 53/135 |
| 4,005,563 | 2/1977 | Nitsch | 53/583 |
| 4,063,477 | 12/1977 | Hantke | 83/382 |
| 4,356,054 | 10/1982 | Gotz | 83/382 X |
| 4,730,434 | 3/1988 | Knudsen | 53/138 A |

*Primary Examiner*—John Sipos

*Attorney, Agent, or Firm*—Gravely, Lieder & Woodruff

[57] ABSTRACT

A machine for applying a twist-type tie to the neck of a bag has a path and sets of endless belts which come together at a nip along the path to propel a bag neck which passes into the nip forwardly to a typing zone in the path. Here a twist-type ribbon crosses the path and is secured at its end in a holder. An endless chain carries a pusher tab up to the tying zone behind the bag neck, causing the bag neck to gather behind and deflect the ribbon, then pauses, and thereafter resumes its forward motion to drive the bag neck out of the machine. During the pause a bag clamp secures the bag neck against a surface that is along the path and a needle lifts a portion of the ribbon upwardly behind the gathered bag neck and brings that portion of the ribbon to the holder so that the ribbon loops below the bag neck in the form of leading and trailing segments. While the needle is so extended, a twister hook gathers its leading and trailing segments and twists them together. As the tie is completed, the holder shears the trailing segment of ribbon and at the same time grips that segment so the ribbon remains extended across the path. A ribbon stripper moves forwardly from behind the twister hook and clears the severed twist tie from the tying zone as the pusher tab resumes its forward motion.

22 Claims, 15 Drawing Sheets

MACHINE FOR APPLYING TWIST-TYPE TIES

RELATED APPLICATION

This application is a continuation of application Ser. No. 881,730, filed July 3, 1986, on which U.S. Pat. No. 4,730,434 will be granted on Mar. 15, 1988.

BACKGROUND OF THE INVENTION

This invention relates in general to applying twist-type ribbons to bags and more particularly to a machine for tying such ribbons around the necks of bags.

Many bakery products, particularly bread loaves and to a lesser measure rolls and buns, are sold in plastic bags which are gathered at their ends and secured with a plastic clip or a twist-type tie. Users prefer the twist-type tie, because it secures the gathered end more tightly and is easier to reapply once removed Indeed, the typical twist-type tie constitutes nothing more than a paper or plastic ribbon having a thin wire embedded within and extending longitudinally through it midway between its sides. While the twist-type tie may be easy for the user to reapply, it is not so easy for the bakery to apply in the first instance, for the packaging lines of bakeries operate at high speeds. A machine exists for applying such ties to bags as they pass along a conveyor, but this machine operates relatively slowly, is expensive, and is not entirely reliable That machine forms the subject matter of U.S. Pat. No. 3,138,904 to E. Burford.

DESCRIPTION OF THE DRAWINGS

In the accompanying drawings which form part of the specification and wherein like numerals and letters refer to like parts wherever they occur

DETAILED DESCRIPTION

Figure 1:
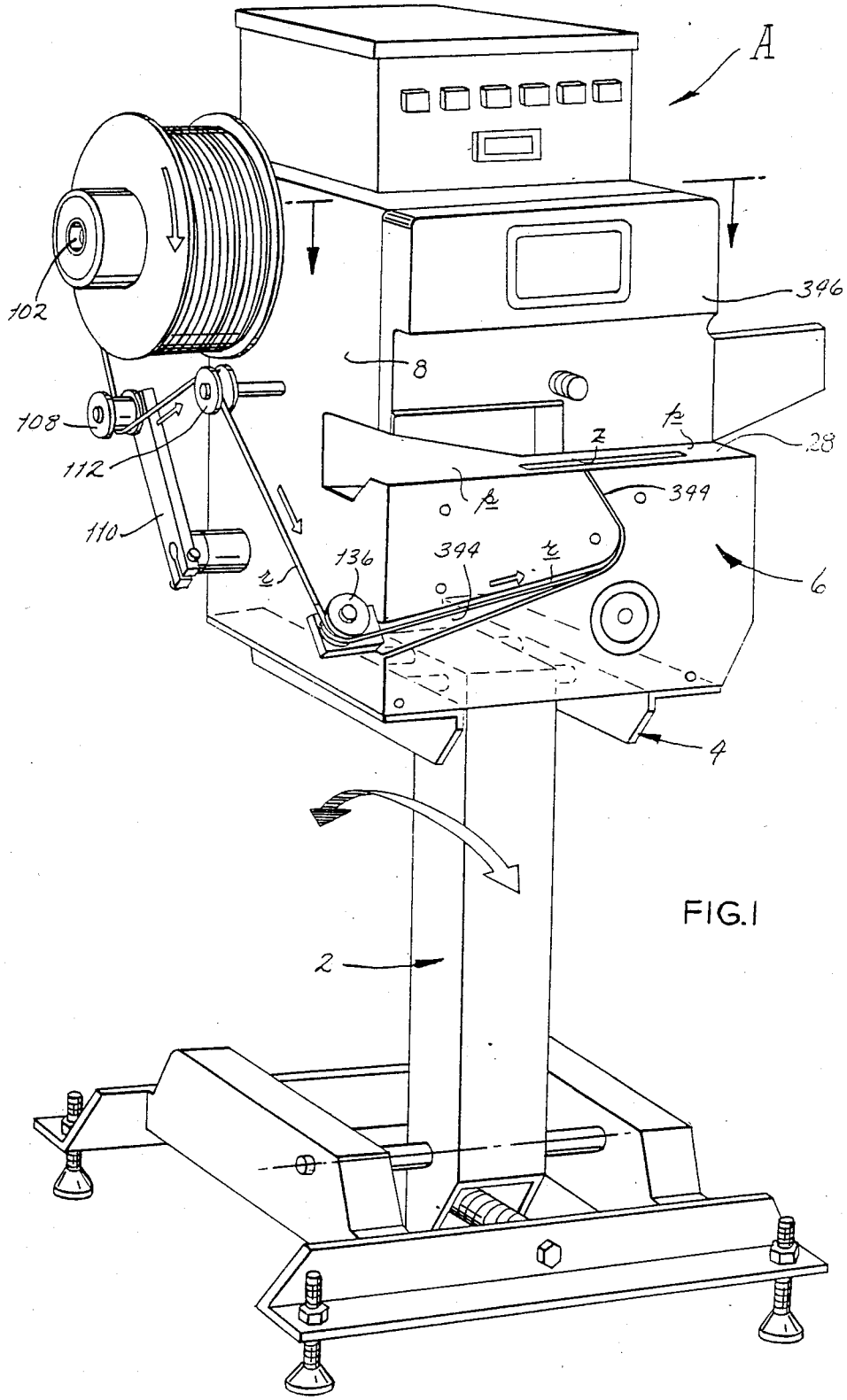
FIG. 1 is a perspective view of a tying machine constructed in accordance with and embodying the present invention.

Referring now to the drawings, a tying machine A (FIG. 1) applies twist-type ties t (FIG. 5*d*) to the ends of bags B (FIG. 2), each of which containing a product which was inserted into it prior to the application of the tie t. Indeed, the ties t, which are derived from a ribbon r (FIG. 1), are usually applied to the bags B at the end of a bagging line in which the products are inserted into the bags B. Thus, at the end of the bagging line the bag B extends over and behind the product, and further projects beyond the product in the form of a neck n (FIGS. 2 & 5). The machine A pulls the projecting neck n to cause the bag B to draw over the product, and further gathers and clamps the neck n With the bag B so disposed the machine A applies the tie t quite close to the product, so that once the machine A releases its grip on the bag B, the bag B remains tightly drawn over the product. The machine A operates on a demand basis, and wraps and twists a tie t only after it senses that the end of a bag B has passed a certain location in the machine A. Indeed, the machine A is designed primarily for use along a conveyor line C (FIG. 2) that moves bagged products with the ends of their bags B projecting laterally beyond the conveyor C, at least at the region of the conveyor where the tying machine A is located.

The tying machine A includes a pedestal 2 (FIG. 1) and a frame 4 which is supported on the pedestal 2 generally at the level of the conveyor C where it is enclosed in a cabinet 6 having side walls 8 that are bolted to the frame 4. The frame 4 includes two lower frame members 10 (FIG. 4) which extend from the front to the rear of the machine A, the front in this context being that end of the machine A into which the neck n of a bag B is projected to have a twist-type tie t placed around it The lower frame members 10 are in turn attached to the pedestal 2. In addition, the frame 4 includes a center plate 12 which is received in upwardly opening notches formed in the lower members 10 and extend upwardly therefrom for the full height of the machine A. The upper edge of the center plate 12, on the other hand, fits into notches formed in a pair of upper frame members 14 which likewise extend from the front to the rear of the machine A directly above the lower frame members 10. Aside from the pairs of upper and lower frame members 10 and 14 and the center plate 12, the frame 4 also includes a rear plate 16 and lower and upper front plates 18 and 20. The rear plate 16 is bolted securely to the ends of the upper and lower frame members 10 and 14 and as such extends the full height of the machine A. The lower front plate 18, on the other hand, extends only about one-half the height of the machine A, it being bolted near its lower edge to the front ends of the lower frame members 10, while near its upper edge it is fastened to spacer bars 22 (FIG. 5) which extend between it and the center plate 12. The upper front plate 20, while being directly above the lower front plate 18, is spaced slightly above the lower plate 18 so that a gap exists between the two plates 18 and 20. Near its upper edge, the upper plate 20 is bolted against the ends of the upper frame members 14, while at its lower left hand corner it is bolted against a spacer bar 24 which extends between it and the center plate 12. Midway between the two upper frame members 14, another spacer bar 26 (FIG. 3) extends between the center plate 12 and the upper front plate 20. Thus, the rear plate 16 and the two front plates 18 and 20 are parallel to the center plate 12.

The gap between the lower and upper front plates 18 and 20 represents a bag path p (FIGS. 4 & 5) through which the necks n of the bags B pass, one after the other, and to accommodate such bag necks n, the path p opens out of the front of the machine A as well as out of each side wall 8. Moreover, the path p extends inwardly to the vertical center plate 12. Indeed, as the bags B are advanced in succession past the machine A on the conveyor C, the loose necks n of the bags B enter the path p at one side of the machine and are discharged from the path at its other side and while the neck n of any bag B is within the path p, the remainder of the bag B, that is the portion containing the product, lies beyond the front of the machine A, indeed on the conveyor C which advances the bag B (FIG. 2). The lower surface of the path p, at least at the feed end of the path p, is formed by a horizontal platen 28 (FIGS. 2 & 4) which rests on the upper edge of the lower front plate 18 and extends rearwardly to the vertical center plate 12 to which it is also secured. Actually, the platen 28 is divided into two segments which are separated by a diagonally extending opening. On the other hand, the upper surface of the path p is at the feed end formed by a relatively narrow bag guide 30 which is bolted to the upper front plate 20 of the frame 4. The leading end of the bag guide 30 (FIGS. 2 & 5) that is the end closest to the feed end of the path p is tapered downwardly at a slight angle to the horizontal platen 28. Both the bag guide 30 and the platen 28 lead up to a tying zone z (FIGS. 2 & 5) that is generally midway between the feed and discharge ends of the path p, and here each bag B is brought to rest with its neck n somewhat gathered When the bag B is so disposed, the ribbon r is placed around its neck n (FIGS. 5*b, c*) then twisted to secure it to the neck n, and finally cut so as to leave the bag B with a twist tie t (FIG. 5*d*) around its neck n. Thereafter, the bag B is again moved along the path p and discharged from the machine A.

Bolted against the front face of the lower front plate is a guide rail 32 (FIG. 2) which extends substantially the full length of the path p and generally forms the outer edge of the path p. The guide rail 32 has an outwardly directed flange which is located slightly below the upper surface of the platen 28 and a downwardly turned rib which lies in front of the lower front plate 20.

At the diagonal space between the two sections of the platen 28, the machine A is provided with a bag drive 34 (FIGS. 3, 5 & 6) which grips the loose neck n of each bag B immediately after the neck n enters the machine A, and advances the neck n at a substantially greater speed than the conveyor C on which the remainder of the bag B advances, while at the same time pulls the neck n into the machine A, that is toward the center plate 12, the latter having the effect of drawing the bag B tightly over the product The bag drive 34 extends along the path p to the tying zone z, and thus the bag neck n remains under its control for substantially all of that portion of the path p which precedes the tying zone z.

The bag drive assembly 34 includes upper and lower units 36 and 38 which are basically the same, in that each includes a carrier plate 40 and head and tail pulleys 42 and 44 on that plate. The pulleys 42 and 44 are grooved and accommodate endless belts 46 which are preferably formed from polyurethane in a circular cross-sectional configuration Indeed, the grooves of the two pulleys 42 and 44 while conforming to the circular cross sections of the belts 46, are not nearly as deep as the belts 46 are thick, so the belts 46 project beyond their respective pulleys 42 and 44. While the pulleys 42 and 44 are on one side of the carrier plate 40, that is the side which faces the conveyor C the carrier plate 40 has a small gear motor 48 mounted on it against its opposite face. The gear motor of the upper unit 36 is coupled to the head pulley 42 for rotating the same, while the gear motor 48 for the lower unit 38 drives another pulley 49 (FIG. 5*a*) that is between the head and tail pulleys 42 and 44 of that unit. The speed of the motors 48 may be varied, but they are generally set to advance their respective belts 46 at 2½ to 3 times the speed of the conveyor C. In other words, the belts 46 should move at between about 180 and 220 ft/min.

The carrier plate 40 of the lower unit 38 is secured to the platen 28 in a fixed position with respect to the path p, such that the upper passes of the belts 42 are parallel to and project slightly above the upper surface of the platen 28. Moreover, the carrier plate 40 is cocked somewhat with respect to front plates 18 and 20 so that upper passes of the belts 46 are skewed in the path p. Preferably, the angle between the upper passes of the belts 46 and the front plates 18 and 20 is about 25°. Thus, as the neck n of a bag B passes over the platen 28, it will come into contact with the belts 46 at the upper passes thereof.

While the lower unit 38 is mounted in a fixed position on the platen 28, the upper unit 36 is free to move upwardly and downwardly relative to the platen 28 and path p, yet is restrained both longitudinally and laterally, this being achieved by means of a generally horizontal pivot link 50 (FIGS. 3 & 6) which extends between the carrier plate 40 for the upper unit 36 and a block 52 which is attached to the center plate 12. Since the link 50 is connected to both the carrier plate 40 and the block 52 at pivot pins, the upper unit 36 may be raised and lowered and may further be pivoted at either end upwardly or downwardly with respect to the lower unit 38. The pulleys 42 and 44 of the upper unit 36 lie directly above the corresponding pulleys 42 and 44 of the lower unit 38 so that the lower passes of the belts 46 on the upper unit 36 are parallel to the upper passes of the belts of the lower unit 38. However, the grooves in the pulleys 42 and 44 for the upper unit 36 are offset slightly with respect to the grooves for the pulleys 42, 44 and 49 of the lower unit 38, with the offset being such that the belts 46 of the upper unit 36 fit between the belts 46 of the lower unit 38.

Of course, the motors 48 of the two units 36 and 38 drive the belts 46 of those units such that the adjacent and parallel passes—that is the upper pass of the lower unit 38 and the lower pass of the upper unit 36—move in the same direction, and that direction is toward the tying zone z. Thus, when the neck n of a bag B moves across the platen 28, its leading edge will after a short distance pass into the nip formed by the upper and lower belts 46 as they come around their respective head pulleys 42. Being offset and somewhat meshed, the belts 46 grip the bag neck n and advance it rapidly over the platen 28—indeed more rapidly than the conveyor C on which the bagged products are transported. As a consequence, the neck n is brought ahead of or at least even with the leading face of the bag B and is discharged at the tying zone z in that condition The bag neck n discharges against the ribbon r and thus tends to gather on the platen 28 behind the ribbon r, yet immediately ahead of the feed assembly 34. Moreover, by reason of the skew in the meshed passes of the two sets of belts 46, the belts 46 while they grip and advance the bag neck n also move the neck n toward the center plate 12, and this of course causes the bag B to draw snugly over the product, so that the bag B will not be loosely fitted after the twist tie t is secured.

Even though the belt grooves of the pulleys 42 and 44 for the two drive units 36 and 38 are offset so that the parallel passes of the belts 46 mesh, the two head pulleys 42 have somewhat wider grooves which align, and these grooves, at the nip between the two pulleys 42 accommodate a sensor arm 54 (FIGS. 5 & 6) that projects into the nip from below the platen 28. Actually the sensor arm 54 forms part of a bag sensor 56 which also includes a housing 58 that is bolted against the underside of the platen 28. Indeed, the sensor arm 54 is attached firmly to the shaft 60 which within the housing 58 is counter-balanced and spring biased such that its free or upper end is urged upwardly to project through an opening in the platen 28 and into the nip at the head pulleys 42 unless otherwise restrained When the shaft 60 rotates through a prescribed angle, which is quite small, it causes a beam of light within the housing 58 to be interrupted, and this interruption generates a signal which is transmitted by a fiber-optic cable to a logic module (not shown on the center plate 12. Thus, as a bag neck n is gripped by the belts 46 at the nip formed at the two head pulleys 42, the leading edge of the neck n will drive the sensor arm 54 downwardly, causing the shaft 60 to rotate. The arm 54 remains down for as long as the bag neck n is over it, but once the trailing edge of the neck n passes beyond the nip and arm 54, the arm 54 swings upwardly, and the bag sensor 56 generates a signal Hence, the sensor 56 not only detects the presence of a neck n along the path p, but also detects when the neck n clears a specific point in the path p.

At the tying zone z to which the belts 46 drive the bag neck n, is a ribbon holder 66 (FIGS. 5 & 7–9) which includes a clamping block 68 that is bolted against the front face of the upper front plate immediately above the path p, a clamping bar 70 which moves to and fro within the block 68, and a shear plate 72 which is attached to the underside block 68 and serves as a ledger along which the ribbon r is severed. In addition, the ribbon holder 66 includes a double acting air cylinder 74 which is connected between the clamping bar 70 and the frame 4 so as to move the bar both ways within the block 68.

More specifically, the clamping block 68 projects forwardly from the upper front plate 20, and slightly beyond the exposed longitudinal edge of the guide rail 32 it has a cavity 76 (FIG. 9) which opens upwardly and also laterally toward the feed end of the path p. Between the base of the cavity 76 the bottom of the block 68 is a clamping slot 78, each side of which constitutes a jaw 80 containing a horizontal groove 82. The slot 78 at its one end opens out of the block 68 and toward the feed end of the path p, while at its other end it opens into another cavity 84 which is occupied for the most part by the clamping bar 70.

Indeed, within the cavity 84 the clamping bar 70 is connected to the block 68 by a pivot pin 86 which extends through the bar 70 and threads into the block 68. On one side of the pin 86, the bar 70 is tapered and projects into the clamping slot 78 where on each of its sides it has a convex rib 90. The tapered sides of the bar 70 are presented toward the jaws 80 that line the slot 78 in the block 68, all such that the ribs 90 align with and conform in configuration to the grooves 82 in the jaws 80. The arrangement is such that the tapered end of the bar 70 pivots between the jaws 80, and when against either jaw 80, the convex rib 90 on that side of the bar 70 will actually enter the aligned groove 82 of the jaw 80. Should the ribbon r be between the tapered end of the bar 70 and either jaw 80 of the clamping slot 78 as the tapered end moves toward that jaw 80, the ribbon r will be driven into the groove 82 of the jaw 80 by the aligned rib 90 on the bar 70, and thereby clamped securely between the bar 70 and the jaw 80.

Figure 8A:
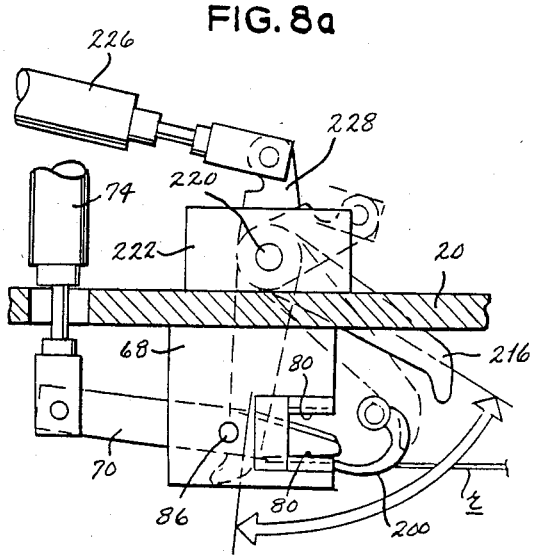
FIGS. 8*a* and *b* are plan views taken along line 8—8 of FIG. 7 and showing the bar of the ribbon holder in the two positions by which it clamps and secures the end of the ribbon FIGS. 9*a* and *b* are perspective views of the ribbon holder with the latter showing the holder path broken away and in section.
Figure 8B:
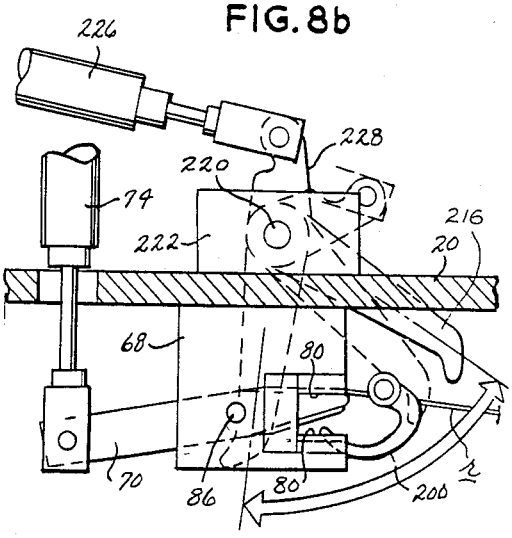
Figure 9A:
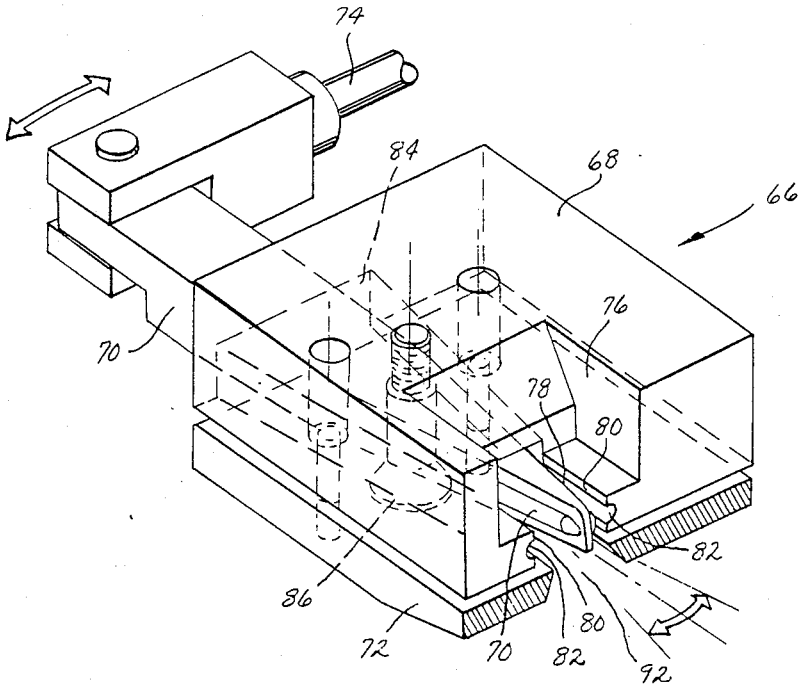
Figure 9B:
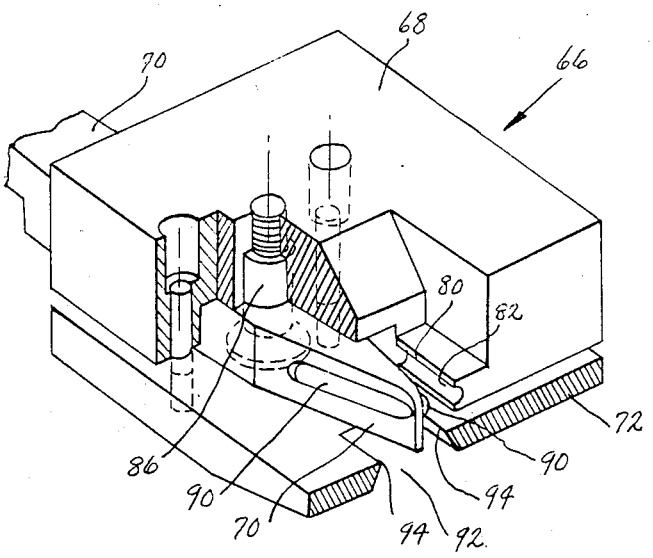

The bar 70 likewise extends beyond the opposite side of the pivot pin 86 and indeed out of the other cavity 84. Beyond the cavity 84, it is connected to the air cylinder 74 (FIG. 7) at a clevis. The cylinder 74 extends through the upper front plate 20 and behind that plate is connected to the center plate 12 through another clevis. Thus, when the piston rod of the cylinder 74 is extended, the tapered end of the clamping bar 70 moves toward and perhaps against the jaw 80 located closest to the surface of the upper front plate 20 (FIG. 8*b*). Conversely, when the piston rod is retracted, the tapered end of the bar 70 moves toward and perhaps against the opposite jaw 80 (FIG. 8*a*). In any event, the tapered end of the bar 70 is always at one jaw 80 or the other, leaving space in the clamping slot 78 for reception of the ribbon r. After the ribbon r is brought up to and inserted into that space, the cylinder 74 is energized to move the tapered end of the clamping bar 70 toward the opposite side jaw 80, and as a consequence the ribbon r is clamped between the bar 70 and that opposite jaw 80.

The shear plate 72 lies beneath the clamping block 68 to which it is bolted, and it contains a cutout 92 (FIG. 9) that is directly below the clamping slot 78, so that the clamping slot 78 opens downwardly through the cutout 92. The sides of the cutout 92 are set slightly inwardly from the surfaces that form the jaws 80 and are further beveled so as to present cutting edges 94 which are exposed at the bottom of the clamping slot 78. Moreover, the lower surface of the clamping bar 70, at least at its tapered end, is planar and wipes across the cutting edges 94 as the bar 70 pivots to and fro between the jaws 80 of the block 68. Hence, as the tapered end moves toward either jaw 80 to clamp the ribbon r, its lower surface will, before the clamping is effected, wipe across the cutting edge 94 below that jaw 80 and sever the ribbon r at that location Even though the plate 72 is bolted to the clamp block 68, a slight space or gap exists between the plate 72 and the block 68, at least in the region of the clamping slot 78 for the block 68 and the cutout 92 of the plate 72.

In summary, the clamping bar 70 simultaneously cuts and clamps the ribbon r each time the air cylinder 74 causes the bar 70 to pivot about the axis of the pivot pin 86—assuming of course that the ribbon r prior to the rotation of the bar 70 is extended through the clamping slot 78 in the block 68 and the underlying cutout 92 in the shear plate 74—and this holds true irrespective of the direction in which the bar 70 is rotated. The portion of the ribbon r which is severed falls free of the ribbon holder 66 and constitutes a tie t for securing the neck n of a bag B. The clamped portion of the ribbon r, on the other hand, constitutes the very end of an extended length of ribbon r which passes obliquely through the path p at the tying zone z. Indeed, the neck n of the next bag B that is to be tied is brought against the obliquely extending portion of the ribbon r where that neck n tends to gather by reason of the obstruction created by the ribbon r.

Figure 10:
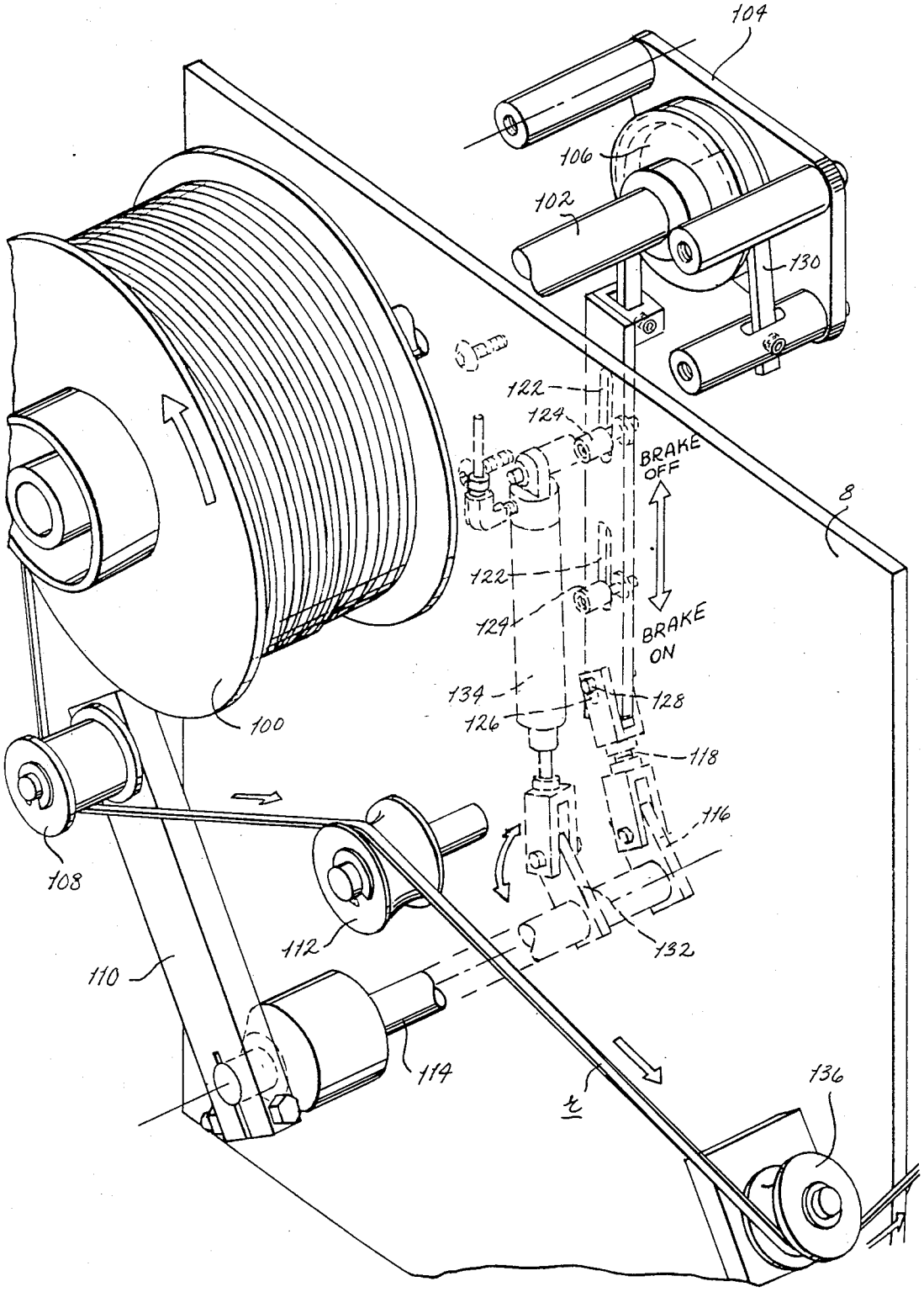
FIG. 10 is an exploded perspective view showing the mechanism by which twist-type ribbon is fed to the ribbon holder.

The ribbon r, which at its end is gripped and held by the ribbon holder 66, pays off of a reel 100 (FIG. 10) that fits over a spindle 102. The spindle 102 rotates on a bearing block 104 which is located within the cabinet 6, yet is mounted on one of the cabinet side walls 8, and at the block 104 is fitted with a brake pulley 106 containing a V-groove. Upon comming off of the reel 100, the ribbon r passes under a tension roller 108 which is located at the end of a ribbon tension arm 110 and thence over an idler roller 112 which is located somewhat higher than the roller 108 where, in contrast to the tension roller 108, it rotates about an axis that is fixed in position on the cabinet wall 8. Moreover, the ribbon tension arm 110 is directed generally away from the idler roller 112 so that any tension within the ribbon r tends to draw the roller 108 and its arm 110 toward the idler roller 112. The tension arm 110 extends from a shaft 114 to which it is firmly clamped, and the shaft 114 is parallel to but located below the spindle 102 where it rotates in a bearing block that is mounted on the cabinet wall 8. At its inner end the shaft 114 is fitted with a brake arm 116, and the brake arm 116 is in turn connected by means of an adjustable link 118 to an elongated slide 120 that extends upwardly along the inside face of the cabinet wall 8 toward the brake pulley 106 of the spindle 102. The slide 120 contains longitudinal slots 122 through which guide pins 124 pass, those pins being secured to the inside face of the cabinet wall 8. Each pin 124 has a shoulder and a head where it is received in its respective slot 122 so that the two pins 124 prevent the elongated slide from moving laterally within the cabinet, but do not impede longitudinal or vertical movement of the slide 120 toward and away from the brake pulley 106 within the confines of the slots 122, of course At its lower end the slide 120 contains another slot 126 through which another pin 128 passes, this pin further extending through the upper end of the adjustable link 118 for connecting the link 118 to the slide 120. At its upper end, the slide 120 is attached to a brake belt 130 which loops over the brake pulley 106 in the V-groove thereof and is secured in an anchor which is mounted on the bearing block 104 Friction occurs between the pulley 106 and the belt 130, and this has the effect impeding rotation of the spindle 102, causing greater tension in the ribbon r as it pays off of the reel 100.

Adjacent to the brake actuator arm 116, the shaft 114 is fitted with a control arm 132 to which the end of an air cylinder 134 is connected, the opposite end of the cylinder being on the cabinet wall 8 itself Air at a selected pressure is delivered to the cylinder 134 which, acting through the control arm 132, applies a torque to the shaft 114, and this torque is resisted by the ribbon r as it loops under the tension roller 108. Should the ribbon r break or detach from the ribbon holder r, it will no longer offer any resistance to the tension arm 110, and the air cylinder 134 will cause the shaft 114 to rotate As a result, the adjustable link 118 will drop downwardly until the pin 128 which connects it to the slide 120 bottoms out in the slot 126 of the slide 120. When this occurs, the torque exerted on the shaft 114 by the air cylinder 134 is resisted at the slide 120 and brake belt 130. Thus, the belt 130 applies a braking force to the spindle 102 to prevent the reel 100 from turning and discharging unneeded ribbon r.

On the other hand, the tension in the ribbon r may become excessive, and when this occurs, the ribbon r acting through the tension roller 108 draws the tension arm 110 upwardly. The shaft 114 of course rotates and at its opposite end lifts the adjustable link 118. If the rotation is great enough, the link 118 will bring the connecting pin 128 to the upper end of the slot 126 in the slide 120 and lift the slide 120, thereby reducing the frictional resistance between the brake belt 130 and the pulley 106. This in turn relaxes the tension in the ribbon r.

Beyond the idler roller 112 which is located on the same side wall 8 as the tension roller 108 and reel 100, the ribbon r passes over a corner roller 136 located at one of the front corners of the cabinet 6, and thence along the lower front plate 18 to a front roller 138 (FIG. 5) which is mounted on the front plate 18 somewhat ahead of and below the tying zone z. Indeed, the ribbon r loops around the front roller 138 to extend diagonally upwardly through the path p and to the ribbon holder 66 where its end is clamped between the clamping bar 70 and one of the jaws 80 on the clamping block 68.

While the bag drive 34 moves the neck n of each bag B toward and into the tying zone z and further pulls the bag B laterally so as to draw it snugly over the product, the actual advancement of the bag neck n into the awaiting ribbon r, that is the segment which extends through the path p, is effected by means of a bag pusher 148 (FIGS. 5 & 11) which in contrast to the bag drive 34 operates intermittently. Indeed, with each actuation of the bag pusher 148 a different bag neck n is pushed into and presented at the tying zone z where the awaiting ribbon r is looped around it, then twisted, and subsequently severed so as to provide the bag neck n with its own twist tie t.

Figures 14, 15:
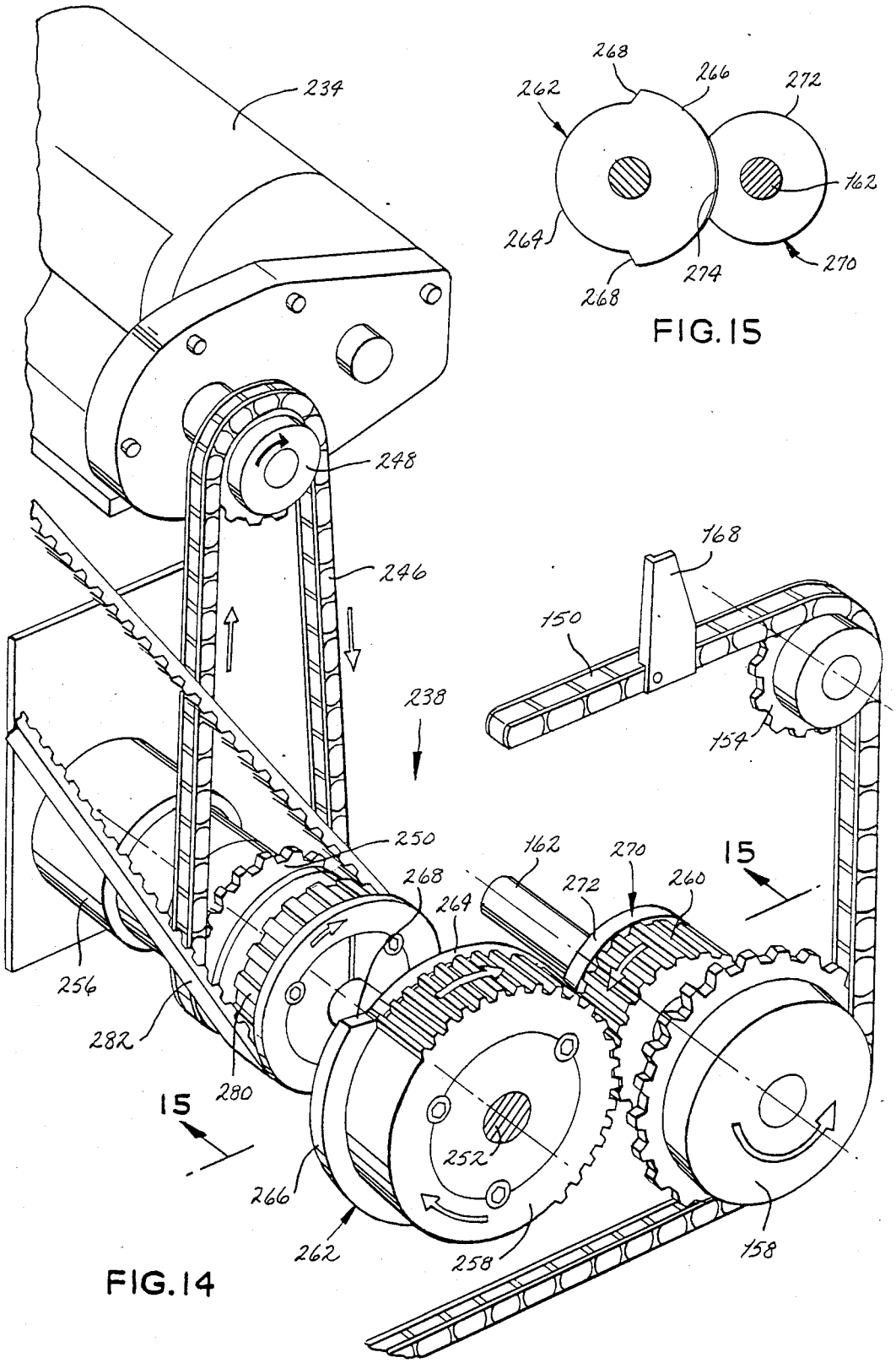
FIG. 14 is a fragmentary perspective view showing the shafts and gear which power the endless chain.
FIG. 15 is a sectional view taken along line 15—15 of FIG. 14 but showing the antirotation plates for locking the drive shaft that powers the endless chain.

The bag pusher 148 is for the most part presented along the front face of the lower front plate 18, that is along the face of the plate 18 that faces the conveyor C. It includes an endless roller-type chain 150 which assumes a somewhat rectangular configuration similar to that of the lower front plate 18, this configuration being dictated by four sprockets 152, 154, 156, and 158 over which the chain 150 passes and with which it is engaged. The two uppermost sprockets 152 and 154 are located at opposite corners of the plate 18 and position the upper pass of the chain 150 immediately below the rib on the outwardly directed flange of the guide rail 32, which is essentially at the elevation of the platen 28 over which the major portions of each bag neck n passes. The two sprockets 152 and 154 rotate on stub shafts which are secured to the front plate 18, and the same holds true with regard to the sprocket 156 which is directly below the sprocket 152, but the stub shaft for the sprocket 156 may be adjusted upwardly and downwardly to control the tension in the chain 150. All three sprockets 152, 154 and 156 are the same diamter and constitute idlers The fourth sprocket 158, which is located directly below the idler sprocket 154, in contrast to the sprockets 152, 154 and 156, is relatively large and is mounted on a sprocket shaft 162 (FIGS. 3 & 14) which extends through and rotates in bearings 164 (FIG. 6) that are mounted on the lower front plate 18 and the center plate 12. The drive sprocket 158, however, may be adjusted angularly with respect to the shaft 162 to control the timing of the pusher assembly 148.

Figure 11:
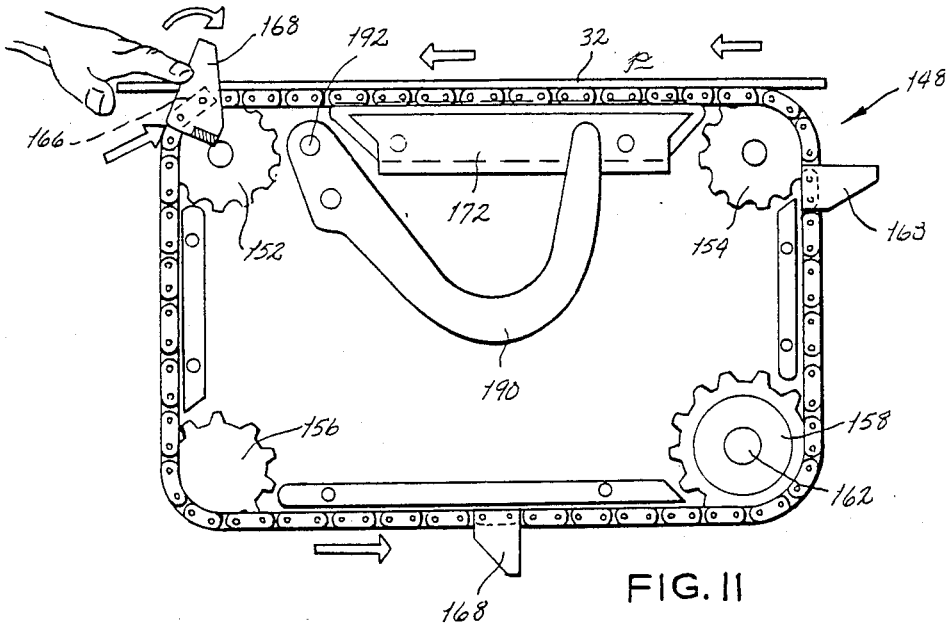
FIG. 11 is a front elevational view of the bag pusher.
Figure 12:
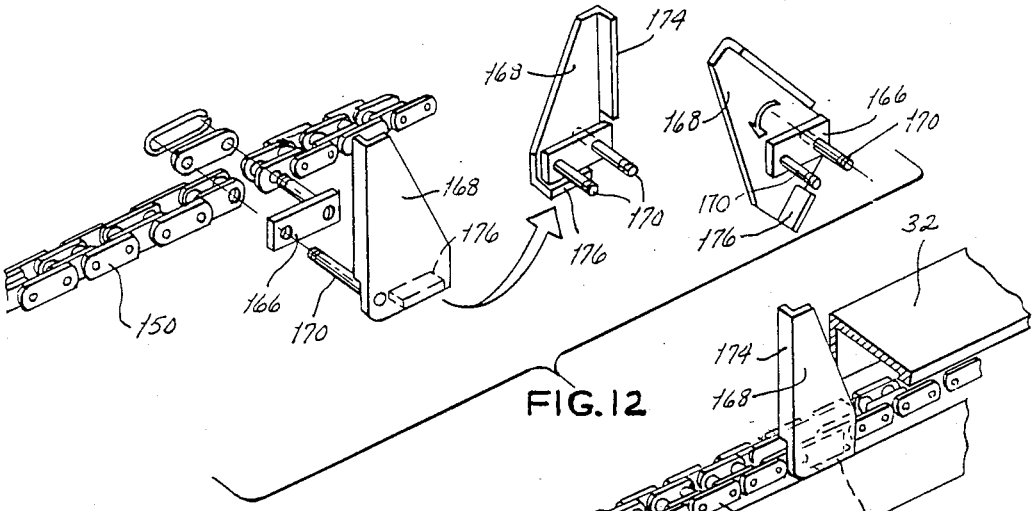
FIG. 12 is an exploded perspective view showing the tabs of the bag pusher and the means by which they are connected to the endless chain.
Figure 13:
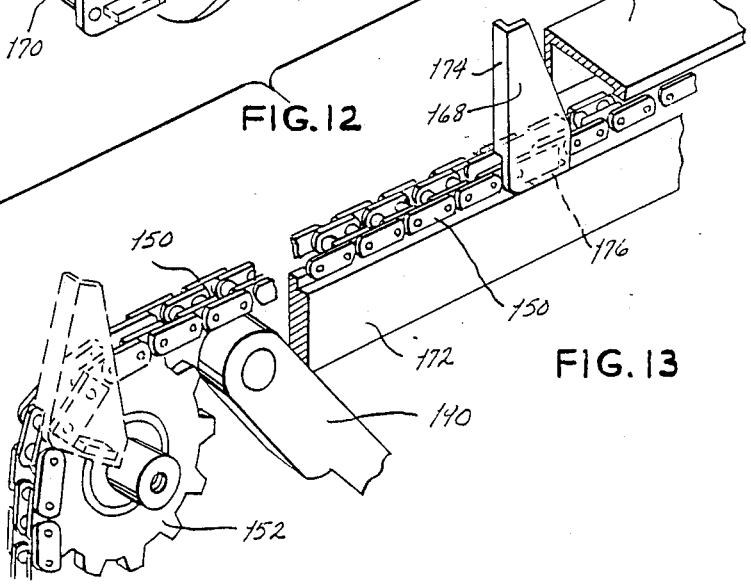
FIG. 13 is a fragmentary perspective view showing the bag pusher.

With regard to that timing, the chain 150 at three equally spaced intervals has squared off master links 166 (FIGS. 11–13), each of which carries a push tab 168 which normally projects outwardly from the chain 150. Indeed, each tab 168 is located against the front face of the squared off link 166 on which it is carried and has a pin 170 which projects through the link 166 and forms the first of the two pins 170 for the link 166 (FIG. 12). While the pin 170 is attached firmly to the tab 168, it rotates easily within the squared off link 166, thus enabling the tab 168 to pivot relative to the link 166 and the chain 150 of which it forms a part, assuming of course that the tab 168 is not otherwise restrained.

The tabs 168 are indeed free to pivot along most of the chain 150 except in the region between the two upper sprockets 152 and 154, which is of course where the upper pass of the chain 150 exists. Here the rollers of the chain 150 pass beneath the downwardly turned rib on the guide rail 32 and over a track 172 (FIG. 11) which is bolted against the lower front plate 18 so the chain 150 in this region is captured between the guide rail 32 and the track 172. Moreover, any tab 168 in this region of the chain 150 also rides on the track 172 which prevents the tab 168 from pivoting rearwardly with respect to the direction of advance for the chain 150. !lore specifically, each tab 168 is for the most part a flat plate-like element having the general configuration of a right triangle, it being attached to the chain 150 solely by the leading pin 170 for the link 166 along which it is located (FIG. 12). That pin 170 projects perpendicularly and horizontally from the tab 100 in the region of its right angle apex. One of the remaining sides forms the leading edge of the tab 168, at least when the tab 168 is in an elevated position as it would be over the track 172, and along the leading edge, the tab 168 has a rib 174 which projects over the link 166 to exist above the link 166 at the upper pass of the chain 150. The rib 174, provides a pushing surface which is the surface at which the tab 168 actually comes against the neck n of a bag B. While the rib 174 extends to the free end of the tab 168, it terminates somewhat away from the link 166, at least when the tab 168 is in its elevated position on the chain 150. Even so, the rib 174 extends far enough along the leading edge of the tab 168, to come against the outer edge of the link 166 when pivoted rearwardly out of its elevated position, and indeed when the rib 174 is against the outer edge of the link 166, the tab 168 is in its retracted position.

Along its remaining side the tab 168 has a shoe 176 (FIG. 12), which like the rib 174 is directed toward the lower front plate 18, but the shoe 176 lies inwardly from the chain 150 and is no wider than the outermost plate of the squared off link 166 so it will pass to the sides of the sprockets 152, 154, 156, and 158. Indeed, when the tab 168 is in its elevated position, the shoe 176 is against the inner edge of the squared off link 166 and thus serves to position the leading edge and rib 174 generally perpendicular to that segment of the chain 150 along which the tab 168 is located The upper surface of the track 172 is actually at two levels - one for the rollers of the chain 150 and the other for the shoes 176 of the tabs 168. Thus, along the track 172 the chain 150 at its rollers is captured between the rib of the guide rail 32 and the upper level of the track 172, while any tab 168 along that portion of the chain 172 is at its shoe 176 captured between the lower or inside edge of its squared off link 166 and the lower level of the track 172, yet is free to slide along the track 172, which it does This confinement of the chain 150 and shoe 176 by the guide rail 32 and track 172 holds the tab 168 in its upright or elevated position as the tab 168 passes over the track 172, and as a consequence the tab 168 will push any bag neck n that lies ahead of it on the path p toward the tying zone z. However, the chain 150 advances the tab 168 at a velocity less than that of the belts 46 in the bag drive assembly 34, so the end portion of the bag neck n which is gripped in the belts 46 of the bag drive 34 normally leads the portion which is more closer to the product, which is of course the portion against which the pusher tab 168 bears. The sprocket shaft 162 rotates incrementally, and with each incremental advance, moves a different tab 168 up to the tying zone z and then abruptly brings the chain 150 and the tabs 168 on it to rest. That tab 168 which moves into the tying zone z during this incremental advance drives the portion of the (bag neck n that it contacts against the segment of the ribbon r which extends upwardly through the path p to the ribbon holder 66 where the end of the ribbon r is secured, the advance being enough to deflect the ribbon r slightly. As a consequence, the bag neck n gathers between the ribbon r and the tab 168.

The track 172 extends beyond the tying zone z, so when the chain 150 is again energized, the elevated tab 168 moves the gathered bag neck n out of the tying zone z. However, the track 172 terminates prior to the sprocket 152, and once the tab 168 passes off of the track 172, it is free to swing backwardly to its retracted position (FIG. 11). Thus, the tab 168 does not present a hazard as it passes over the sprocket 152, for it will merely drop backwardly if it comes into contact with anything.

While the chain 150 is at rest with one of its tabs 168 in the tying zone z, the neck n of a bag B is gathered between that tab 168 and the segment of ribbon r which extends from the front roller 138 up to the ribbon holder 66. Indeed, the ribbon r in this region is deflected somewhat forwardly under the force exerted on the bag neck n by the tab 168. When the bag neck n is so disposed, it is held against the underside of the upper bag guide 30 by a bag neck clamp 180 (FIG. 2) which moves upwardly and downwardly in the path p. The bag neck clamp 180 constitute a horizontal bar which lies below and parallel to the upper bag guide 30 through substantially the entire tying zone z. Being directly below the upper bag guide 30, the clamp 180 further lies inwardly from the chain 150 so it does not interfere with the tabs 168 as they move along the track 172. Furthermore, when the clamp 180 is in its lower position (FIG. **2*a*), it lies below the upper surface of the platen 28 and the upper surface of the guide rail 32 as well. As such, it does not interfere with the bag necks n as they move over the platen 28 On the other hand, when the clamp 180 is elevated (FIG. 2*b*) it will approach the upper bag guide 30 and cause any bag neck n that is within the tying zone z to be clamped and secured between the clamp 180 and the underside of the upper bag guide 30**.

To effect this movement, the clamp 180 is attached to a laterally directed bar 182 which pivots on a block 184 secured to the center plate 12 Near the clamp 180, the bar 182 is connected to the piston rod of a double acting air cylinder 186, the barrel of the cylinder 186, on the other hand, being attached to the back face of the lower front plate 18 Thus, when the cylinder 186 is energized by admitting compressed air to its head end, the piston rod will extend and lift the clamp 180 toward the upper bag guide 30 (FIG. 2*b*), and indeed the machine A is timed so as to energize the cylinder 186 immediately after the chain 150 pauses with one of its tabs 168 at the tying zone z. In that condition the neck n of a bag B is gathered between one of the tabs 168, and the segment of ribbon r that passes upwardly through the path p. Moreover, the cylinder 186 remains energized to hold the bag neck n firmly in place as the ribbon r is looped around it and thereafter twisted to create a twist tie t. However, just as the twist tie t is completed, the cylinder 186 is energized from its rod end to withdraw the clamp 180 (FIG. 2*a*) and thus release the gathered and tied bag neck n from the underside of the upper bag guide 30. In short, the bag neck clamp 180 prevents the bag neck n from being lifted upwardly while the ribbon r is looped underneath it and brought up again to the ribbon holder 66.

The actual looping of the ribbon r beneath the bag neck n is performed by a ribbon needle 190 (FIG. 5) which is located opposite the lower front plate 18 generally in the region between the idler sprocket 152 for the chain 150 and the front roller 138 for the ribbon r. The needle 190, which is located beyond the chain 150 and the tabs 168 on it, possesses a somewhat hooked or U-shaped configuration with the trough of this configuration normally opening upwardly toward tying zone z. At its end closest to the sprocket 152 the needle 190 is attached firmly to a shaft 192 which rotates in bearings 194 (FIG. 14) that are set on the lower front plate 18 and the center plate 12. The shaft 192 rotates in an oscillatory manner to move the needle 190 between a normally retracted position and an elevated position. The opposite end of the needle 190 is bifurcated and carries a small needle roller 196 at the inner ends of the two tines which create the bifurcation, and of course the roller 196 turns between these tines. In the region between its bend and its roller 196, the needle 190 on its backside contains a groove 198 which leads up to the roller 196.

When the needle 190 is in its normal retracted position (FIG. 5*a*), its mounted end as well as its free end lie beneath the guide rail 32, and the ribbon r passes under the front roller 138 on the plate 18 and thence over the needle roller 196 to the ribbon holder 66. The needle roller 196 at the free end of the needle 190 deflects the ribbon r only slightly On the other hand, when the needle 190 is in its elevated position (FIG. 5*c*), it tends to loop generally around the tying zone z, and the needle roller 196 lies over the upwardly opening cavity 76 in the clamping block 68. As such it configures the ribbon r such that the ribbon r passes upwardly through the needle groove 198 to the needle roller 196 and thence downwardly through the cavity 76 and the clamping slot 78 within the clamping block 68, as well as through the cutout 92 in the underlying shear plate 72. Within the slot 78 the ribbon r lies along one of the sides of the tapered end for the clamping bar 70. Thus, when the air cylinder 74 is energized, the bar 70 will bring the ribbon r against one of the cutting edges 94 for the shear plate 72 so as to cut the ribbon r, and will contemporaneously clamp the portion of the ribbon r that is immediately above the cut between the rib 90 on that side of the bar 70 across which the ribbon r passes and the opposite jaw 80 in the clamping block 68. In other words, as the needle 190 moves upwardly out of its retracted position, it brings the ribbon r beneath the gathered neck n of the bag B and then upwardly behind that neck n, so that a segment of ribbon r exists ahead of the bag neck n and another segment exists behind the bag neck n. The leading segment is at its upper end secured between one jaw 80 of the clamping block 68 and the clamping bar 70, while the trailing segment is carried upwardly and forwardly by the roller 196 of the needle 190 and placed between the other jaw 80 and the other side of the clamping bar 70. The latter segment also extends through the cutout 92 of the underlying shear plate 72. Beyond the trailing segment, the ribbon r passes over the needle roller 196 and through the groove 198 in the back side of the needle 190, and thence to the front roller 138 on the lower front plate 18. Both segments or the ribbon r, however, lie beyond the chain 150, so as to be between the product around which the bag B is fitted and the tab 168 that is against the neck n for that bag. With the ribbon r so configured and positioned, its leading and trailing segments are twisted together to form the twist tie t and immediately thereafter the clamping bar 70 is shifted to sever the trailing segment and thereby free the tie t that is so created.

The twist is imparted to the two ribbon segments by a ribbon twister hook 200 (FIGS. 5, 7, & 8) which rotates in the region above the upper bag guide 30 and below the clamping block 66 of the ribbon holder and shear 66 Each time the needle 190 brings a trailing segment of ribbon r upwardly to the ribbon holder 66, the hook 200 undergoes four revolutions about a vertical axis that is presented slightly outwardly from the upper front plate 20 and indeed in general alignment with the leading and trailing segments of ribbon r. At the outset of the first revolution the hook 200 engages the two segments of ribbon and thereafter imparts several turns to them so that they are twisted securely together.

The hook 200 is attached to the lower end of a vertical shaft 202 (FIG. 7) which rotates in a bearing block 203 (FIGS. 4 & 5) that is bolted against the front face of the upper front plate 20. The hook 200 possesses an arcuate configuration for substantially its entire length, with the arc so formed lying in a plane that is perpendicular to the axis of the shaft 202, but where the hook 200 merges with the shaft 202 a somewhat narrow notch 204 is formed, and it is within the notch 204 that the actual twisting occurs. In this regard, the hook 200 when in its rest position, that is the position from which it starts its rotation, has its free end presented generally toward the discharge end of the path p, and this presents the convex surface of the hook 200 outwardly toward the conveyor C on which the bags B move. It is against this convex surface that the leading segment of ribbon r initially lies (FIGS. 5*a, b*). The hook 200 turns as the needle 190 rises out of its retracted position, so that as the needle 190 brings the trailing segment of the ribbon r into the slot 78 of the clamping block 68, the concave surface of the hook 200 is presented toward the trailing segment - and the leading segment as well (FIGS. 5*b, c*).

During the initial revolution for the hook 200 the concave face of the hook 200 gathers the leading and trailing segments of the ribbon r and brings them inwardly to the notch 204 where they are side-by-side. As the rotation continues, the two segments are twisted together, and after several revolutions, the shaft 202 comes to rest with the free end of the hook 200 again pointing toward the discharge end of the path p. While the twister hook 200 is somewhat above the gathered bag neck n, which is held against the underside of the upper guide 30 by the bag neck clamp 180, the actual twist occurs against and immediately above the gathered bag neck n.

Since the hook 200 comes to rest with its free end presented toward the discharge end of the path p, the twist tie t is free to move out of the hook 200 once it is severed from the remainder of the ribbon r, and this occurs when the clamping bar 70 moves and brings the trailing segment across one of the cutting edges 94 on the shear plate 72. Of course when the clamping bar 70 moves, it releases the leading segment of ribbon r, and at the time it shears the trailing segment, it further clamps the portion of the trailing segment that is above the shear plate 72. That portion, once the needle 190 retracts, becomes the leading segment of ribbon r from which the next twist tie t is created.

At its upper end the shaft 202 on which the twister hook 200 is mounted is fitted with a bevel gear 206 (FIG. 4) which meshes with a larger bevel gear 208 on a horizontal twister shaft 210 that extends rearwardly through the upper front plate 20 and the center plate 12 of the frame 4. Indeed, the plates 12 and 20 are fitted with bearings 212 (FIG. 14) which receive the shaft 210. The bevel gear 208 has four times the number of teeth as the gear 206, so for each revolution of the twister shaft 210, the vertical shaft 202 and the twister hook 200 on it undergo four revolutions.

After the clamping bar 70 moves over one of the cutting edges 94 of the shear plate 72 to release the leading segment of ribbon r and sever the trailing segment, the completed twist tie t is physically displaced from the tying zone z, not only by the chain 150 which advances at about this time, but also by a ribbon stripper 216 (FIGS. 7 & 8) which moves through the tying zone z in the region between the lower edge of the upper front plate 20 and the upper surface of the upper bag guide 30. As such it passes directly beneath the twister hook 200. The ribbon stripper 216 projects outwardly from the upper front plate 20, behind which it is attached to a stripper shaft 220 which turns in a bearing block 222 that is fastened to the upper front plate 20 against its back face. For the most part the stripper 216 is straight and flat, but at its free end it curves forwardly somewhat in the provision of a hook 224.

Normally, the stripper 216 is in a rear position where its hook 224 is located generally within the upper bag guide 30 and thus does not interfere with the movement of the ribbon needle 190 upwardly past the front face of the upper guide 30 to place the trailing ribbon segment in clamping block 68 of the ribbon holder 66. However, when the stripper shaft 220 is turned in the appropriate direction, the hook 224 of the stripper 216 emerges from the upper bag guide 30 and proceeds forwardly in an arc, passing under the twister hook 200 and thence under the clamping block 68 and the shear plate 72 as it does. Indeed, the forward movement of the stripper 216 does not cease until the leading edge and hook 224 on the stripper 216 are beyond the cutout 92 in the shear plate 72. In other words, when the stripper shaft 220 rotates, the stripper 216 moves over the tying zone z of the path p and will clear any twist tie t from the region through which it moves.

The forward rotational movement of the stripper 216, and likewise the rearward rotational movement to return the stripper 216 to its initial position, is derived from a double acting air cylinder 226 (FIGS. 7 & 8) which is connected between a crank arm 228 on the upper end of the stripper shaft 220 and a clevis-like mount 230 which is on the front face of the center plate 12. When the piston rod of the cylinder 226 is retracted, the crank arm 228 is generally perpendicular to the upper front plate 20 and the stripper 216 is in its rear position. However, when the piston rod for the cylinder 226 is extended, the stripper shaft 220 rotates and moves the stripper 216 forwardly above the tying zone z for the path p. Between its rear and forward positions, the stripper 216 describes an arc of approximately 90°. Moreover, the cylinder 226 is only energized after the twister hook 200 has twisted the leading and trailing segments of ribbon r together and the clamping bar 70 has released the leading segment and severed the trailing segment to free the completed twist tie t from the clamping block 68.

To summarize the events which occur within the tying zone z of the path p once the bag drive 34 propels a generally flat bag neck n past the sensor arm 54, thereby causing the bag sensor 56 to generate a signal, the drive sprocket 158 of the bag pusher 148 rotates, causing one of the tabs 168 on the chain 150 to move over the idler sprocket 154 and onto the track 172 where it assumes and maintains its upright or elevated position. The tab 168 moves along the track 172 in its elevated position, and as it does it collects the bag neck n and pushes the neck n against the segment of ribbon r which rises through the path and is secured at its end in the clamping block 68 of ribbon holder 66. The bag neck n gathers between the ribbon r and the rib 174 of the tab 168 and indeed deflects the ribbon r forwardly by the time the chain 150 comes to rest with its tab 168 in the tying zone z (FIG. **5*b***).

When the chain 150 stops, the air cylinder 186 is energized, and it elevates the bag neck clamp 180, so that the gathered bag neck n is captured between the clamp 180 and the underside of the upper bag guide 30. With the bag neck n so clamped, the ribbon needle 190 rises out of its retracted position and brings the ribbon r beneath the gathered bag neck n as well as upwardly behind the bag neck n, thus creating leading and trailing segments at the tying zone z. Indeed, the ribbon needle 190 moves to its elevated position (FIG. **5*c*) in which its roller 196 is directly above the clamping block 68 of the ribbon holder 66, and when the needle 190 is so disposed the trailing segment extends through the cavity 76 and slot 78 in the clamping block 68, where it passes along one side of the tapered end for the clamping bar 70. It likewise extends through the cutout 92 in the underlying shear plate 72**.

The ribbon needle 190 moves harmonically and dwells momentarily in its elevated or top dead center position, and while the needle 190 is near and in this position, the twister hook 200 undergoes four revolutions. During about the first 270° of rotation, the hook 200 collects both the leading segment and the trailing segment of ribbon r and brings them inwardly to the notch 204 at the base of the hook 200 where the two segments are in juxtaposition. As the hook 200 continues to rotate, it twists the juxtaposed leading and trailing segments of the ribbon r together, with the twist commencing at the top side of the gathered bag neck n and working upwardly therefrom toward the hook 200 itself.

Figure 5A:
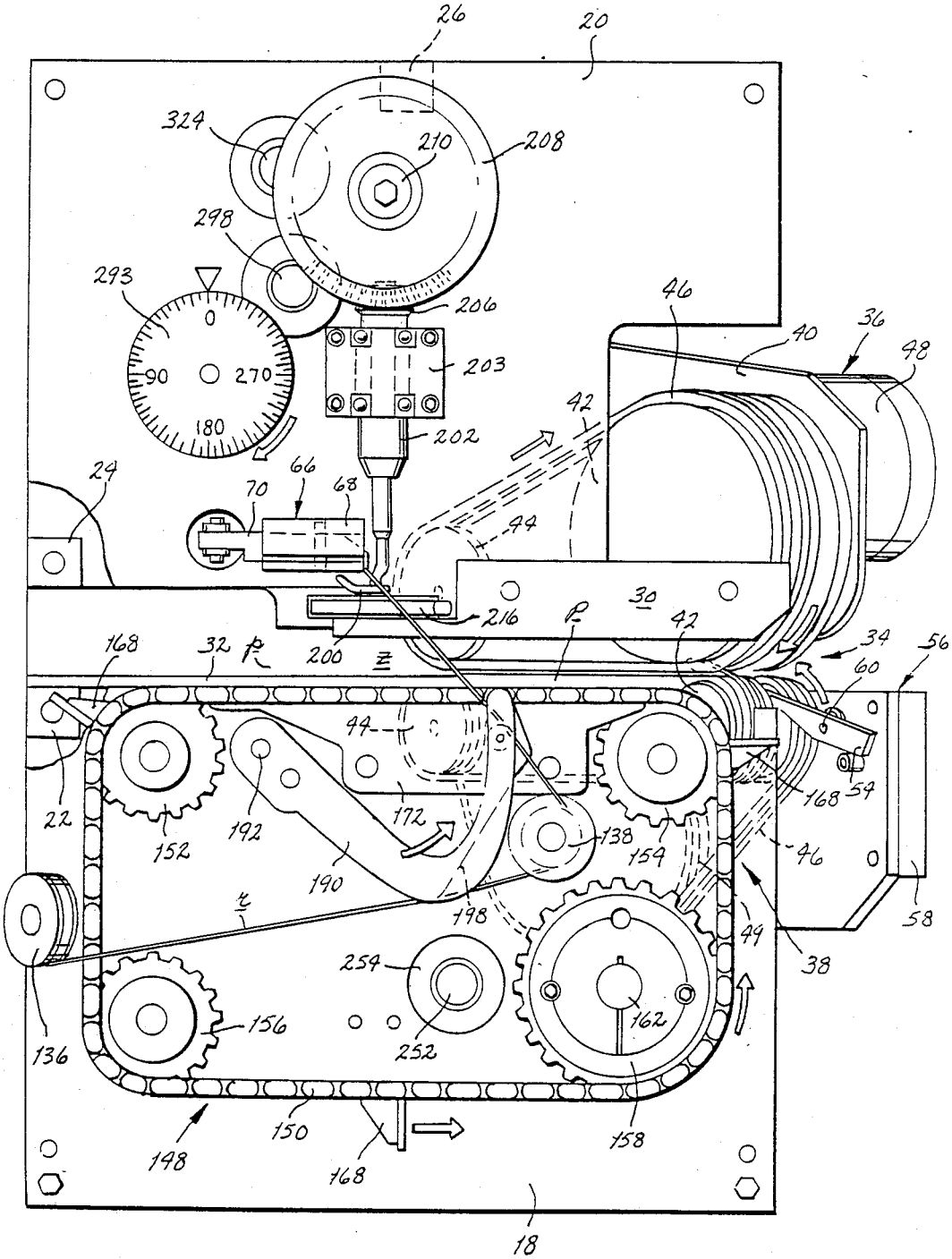
FIGS. 5*a, b, c,* and *d* are front sectional views taken along line 5—5 of FIG. 4 and showing the components of the machine at various stages in the tying process.
Figure 5B:
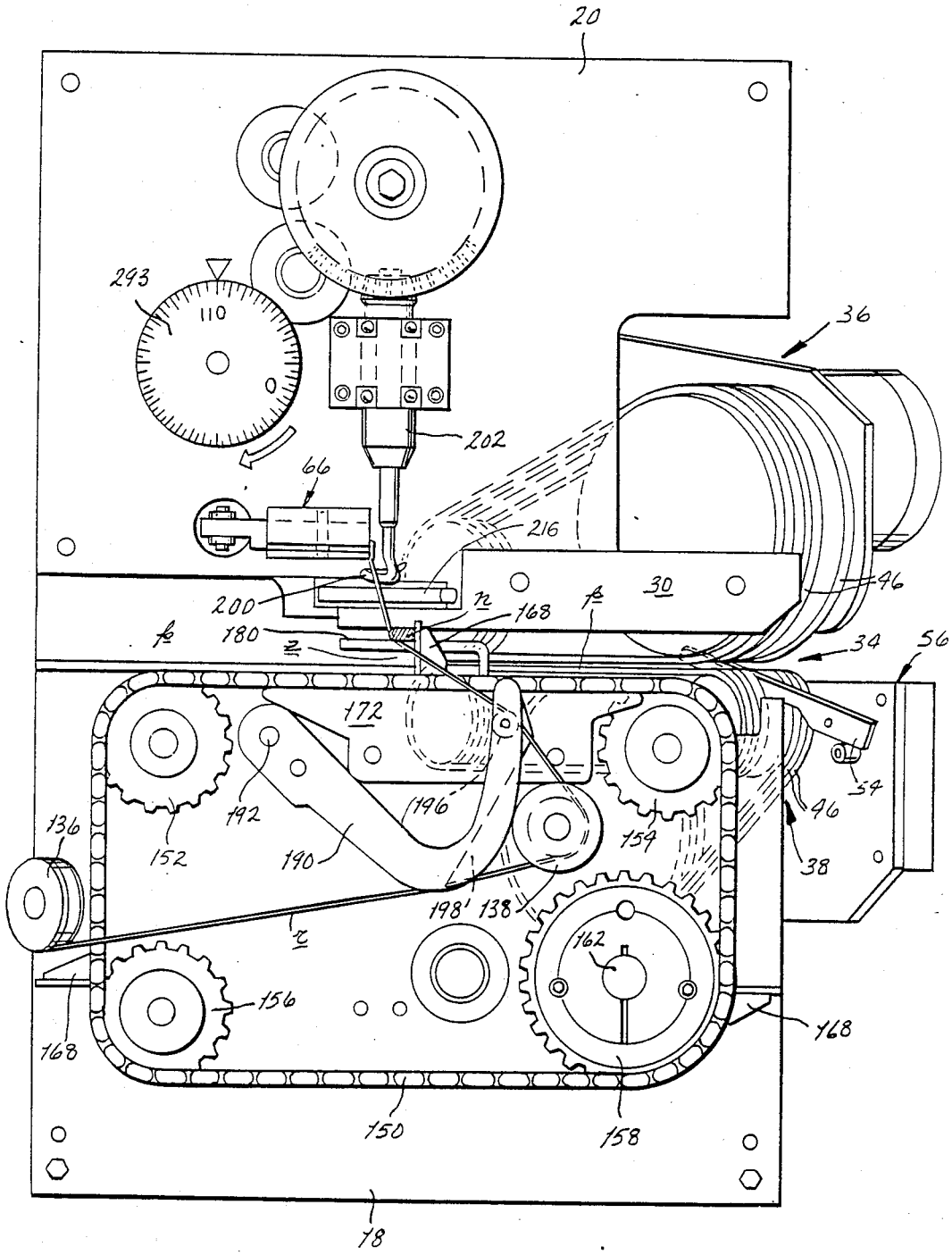

After about 270° of rotation for the twister hook 200, the air cylinder 74 for the ribbon holder 66 is energized to drive the tapered end of the clamping bar 70 to the opposite jaw 80 in the clamping slot 78 of the clamping block 68, and as this occurs the bar 70 releases the leading segment of ribbon r and moves the trailing segment over the opposite cutting edge 94 on the shear plate 72, thereby severing the trailing segment. Contemporaneously the bar 70 clamps the new end of ribbon r against the opposite jaw 80 of the block 68, that is the jaw 80 toward which the bar 70 moves. Thus, a severed twist tie t remains at the tying zone z (FIG. 5*d*).

At about the time the twister hook stops, the cylinder 186 for the bag neck clamp 180 is energized from its opposite end to retract the clamp 180 from the upper bag guide 30 and thereby release the formerly secured bag neck n.

The severed tie t is cleared from the tying zone z by the ribbon stripper 216 which moves forwardly under the torque exerted by the air cylinder 226. As the stripper 216 advances, its hook 224 comes against the twisted portion of the tie t and propels the twisted portion forwardly out from beneath the cutout 92 in the shear plate 72. At the same time, the drive sprocket 158 resumes rotation and moves the chain 150 so that the elevated tab 168 at the tying zone z drives the gathered and tied bag neck n forwardly. Also, the air cylinder 226 is pressurized at its opposite end to move the ribbon stripper 216 back to its original position where its hook 224 is in effect within the upper bag guide 30.

Finally the ribbon needle 190 moves back to its retracted position, and as it does the ribbon r pays off of the roller 196 at its end Since the end of the ribbon r is clamped within the clamping block 68, the needle 190 upon retracting merely leaves the ribbon extended upwardly through the path p to form the leading segment of the subsequent twist tie t.

The movements of the chain 150, the ribbon needle 190 and the twister hook 200 are all derived from an electric gear motor 234 (FIGS. 3, 4 & 6) which is mounted on two support rods 236 that extend between the center plate 12 and the rear plate 16 of the frame 4, whereas the movements of the clamping bar 70 for the ribbon holder and shear 66, the bag neck clamp 180 and the ribbon stripper 216 are derived from their respective air cylinders 74, 186 and 226. To this end, the gear motor 234 is coupled through a drive train 238 to the drive shaft 162 for the sprocket 158 which drives the chain 150, and likewise to the shaft 192 which carries the ribbon needle 190 and the horizontal twister shaft 210 which through the bevel gears 206 and 208 drive the twister hook 200. Indeed, the shafts 162, 192 and 210 could be considered part of the drive (train 238 as could the sprockets 158 and the bevel gears 206 and 208. Moreover, each of the air cylinders 74, 186 and 226 is connected to a source of compressed air through valves 240, 242 and 244 (FIG. 4), respectively, which are operated by the drive train 238. Thus, all of the operations or movements which occur at the tying zone z, whether they be powered by the motor 234 or by the compressed air cylinders 74, 186 and 226, are timed from the drive train 238.

The drive train 238 begins with a chain 246 (FIGS. 3, 4, 6, & 14) that wraps around a sprocket 248 on the gear motor 234 and also around a sprocket 250 on a primary drive shaft 252 that rotates in bearings 254 (FIG. 5) attached to the center plate 12 and to the lower front plate 18. Of course, the shaft 252 extends between the two plates 12 and 18 and further projects rearwardly beyond the latter, the sprocket 250 being on the rearwardly projecting portion. While the sprocket 250 is mounted on the primary drive shaft 252, it is not coupled directly to that shaft, but instead is connected to the shaft 252 through a single revolution clutch-brake 256 (FIG. 3) which operates on the wrap spring principle. Thus, the motor 234 drives the chain 246 continuously, and likewise the sprocket 250 on the clutch-brake 256 rotates continuously. However, the primary drive shaft 252 rotates only when the clutch-brake 256 is energized, and then only for one revolution. The clutch-brake 256 is electrically energized, and once it receives an electrical signal it imparts precisely one revolution to the primary drive shaft 252. That signal comes from bag sensor 56 and occurs each time the end of the sensor arm 54 rises upwardly above the plane of the platen 28, and into the groove within the head pulley 42 of the upper unit 36 for the bag drive 34. As a consequence, each time a bag neck n passes beyond the sensor arm 54, the clutch-brake 256 is energized to in turn set the drive train 238 in motion and thereby effect the synchronized movements of the chain 150, the ribbon needle 190, and the twister hook 200, as well as the clamping bar 70, the bag neck clamp 180 and the ribbon stripper 216.

In the region between the center plate 12 and the lower front plate 18, the primary drive shaft 252 carries a segmented gear 258 (FIG. 14) which rotates adjacent to and at times meshes with a pinion 260 on the sprocket shaft 162 to which the drive sprocket 158 for the chain 150 is attached The teeth of the segmented gear 258 are at the outset of any tying cycle engaged with the teeth of the pinion 260, and indeed the teeth of the two gears 258 and 260 remain engaged long enough to bring one of the push tabs 168 up to the tying zone z. In other words, when the clutch 256 engages and connects the primary drive shaft 252 to the motor 234, the primary shaft 252 rotates, and the segmented gear 258 on it turns the pinion 260, which being on the sprocket shaft 162, rotates the shaft 162 and sets the chain 150 in motion. Initially, one of the three pusher tabs 168 of the chain 150 is poised along the idler sprocket 154 just below the feed end of the platen 28 (FIG. 5*a*). When the segmented gear 258 commences its rotation, it moves the chain 150 such that the tab 168 which is along the idler sprocket 154 is brought upwardly over that sprocket and along the track 172, gathering an awaiting bag neck n as it does. The teeth of the two gears 258 and 260 remain engaged until the tab 168 reaches the tying zone z and indeed pushes the bag neck n far enough into the tying zone z to deflect the awaiting ribbon r (FIG. 5*b*). At this instant the teeth on the segment gear 258 disengage the teeth of the pinion 260, and the gap in the row of teeth for the former is presented opposite to the latter. The segmented gear 258 continues to turn, but the pinion 260 remains at rest, and likewise so does the chain 150 and the pusher tabs 168 on it. When the gap rotates past the pinion 260, the teeth for the segmented gear 258 re-engage the teeth on the pinion 260, and the pinion 260 again rotates. Thus, the segmented gear 258 by disengaging and then re-engaging the pinion 260, imparts an intermittent motion to the pinion 260 and the shaft 162 which carries it. Preferably the segmented gear 258 has 18 teeth and the pinion 260 has 20, a combination which causes the pinion 260 to rotate once each time the teeth of the segmented gear 258 pass by it.

Figure 5C:
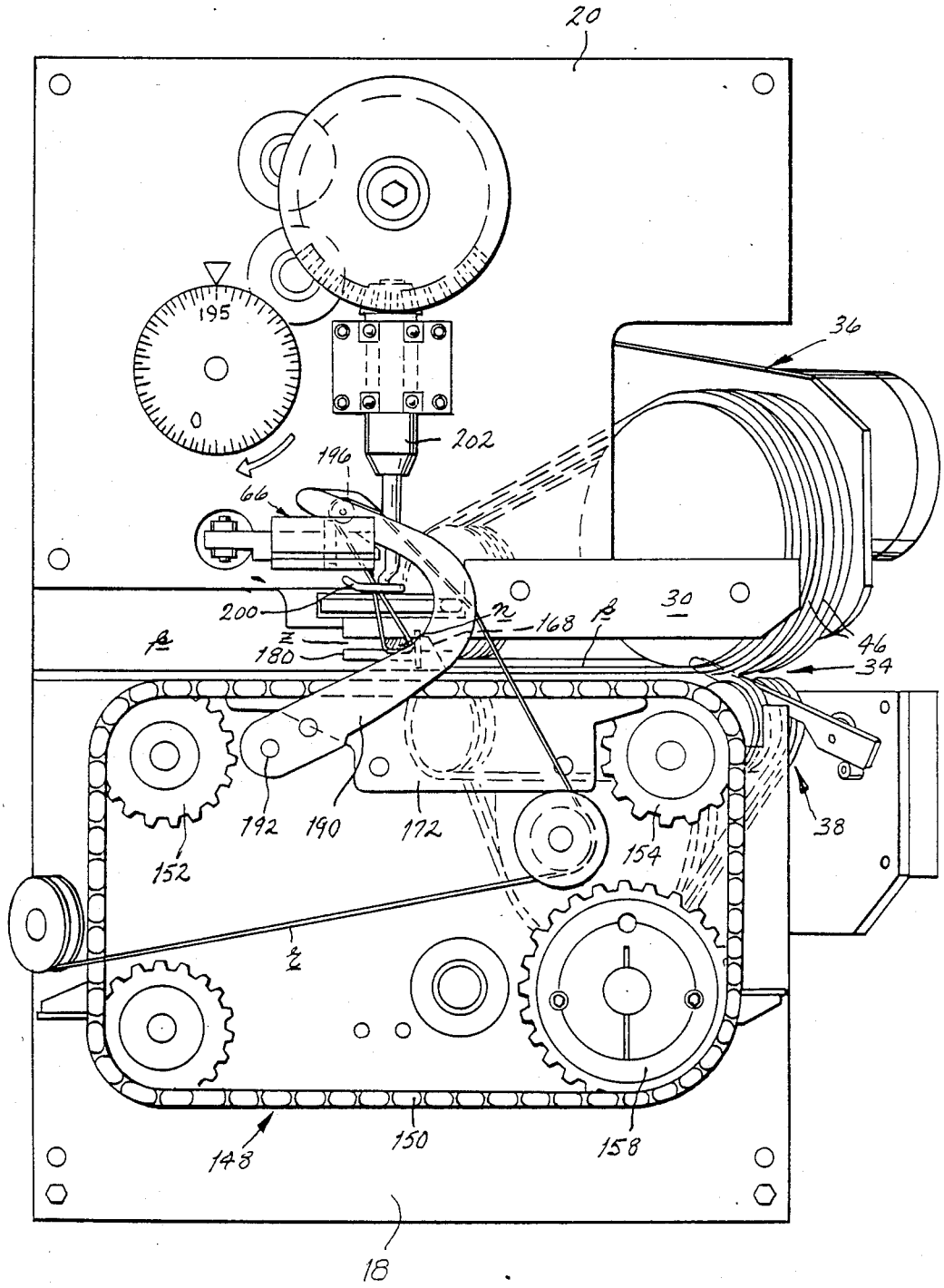
Figure 5D:
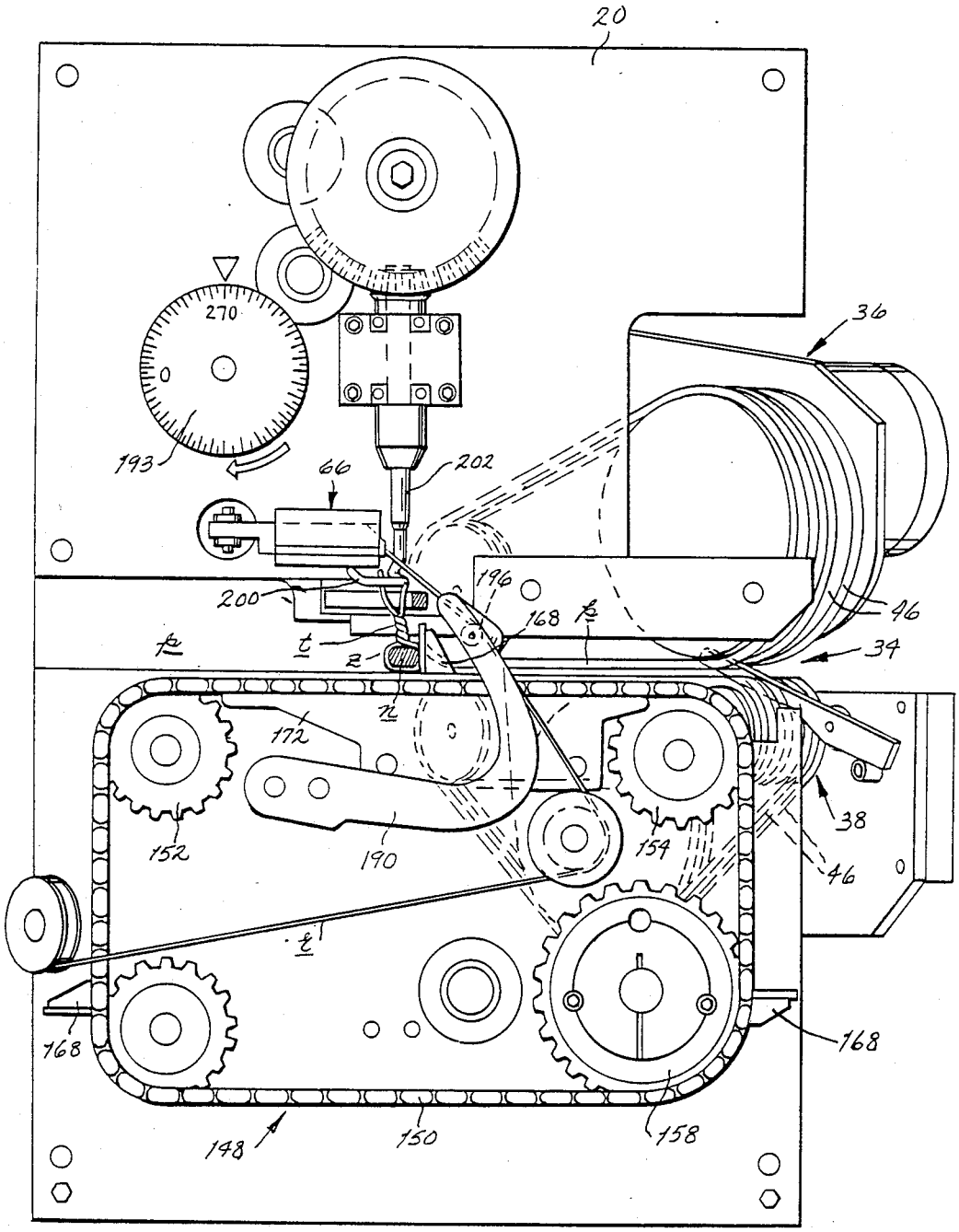

During the interval that the pinion 260 is at rest, the needle 190 brings the ribbon r up behind the gathered bag neck n and the twister hook 200 twists the two segments of the ribbon r together (FIGS. 5*c, d*). Also the clamping bar 70 shifts and severs the ribbon r at the shear plate 72, thus freeing the twist tie t which was so formed. The segmented gear 258 continues to rotate, indeed all the way to the angular position from which it started, and as it does it rotates the pinion 260 far enough to bring the tab 168 on the chain over the idler sprocket 152 at the end of the path p, the tab 168 being just below the guide rail 32 at this point (FIG. 5*a*). The subsequent tab 168 comes to a poised position over the idler sprocket 154, and during the next cycle, that is when the clutch 256 is again engaged, this tab 168 will move to the tying zone z, pause there while a twist tie t is completed, (and then move on to the idler sprocket 152.

Even though the pinion 260 is disengaged from the segmented gear 258 during the dwell when the twist tie t is formed, the pinion 260 and the sprocket shaft 162 on which it is mounted are nevertheless locked against rotation so that neither the chain 150 nor the push tab 168 that is at the tying zone z move during this interval. To achieve this end, the primary drive shaft 252 adjacent to its segmented gear 258 carries an antirotation plate 262 (FIGS. 14 & 15) having two convex surfaces 264 and 266 which are concentric to the axis of the shaft 252, and except for short transition surfaces 268 between them, occupy the full periphery of the plate 262. The convex surface 264 has the lesser diameter of the two and is in the region of the gear 258 where the teeth are located The transition surfaces 268, on the other hand, lead outwardly from the endmost teeth, and those surfaces together with the larger diameter convex surfaces 266 occupy the region of the gear 258 that lacks teeth. The drive shaft 162 on which the pinion 260 is located likewise carries an antirotation plate 270, but the periphery of this plate is defined solely by a relatively long convex surface 272 and a much shorter concave surface 274. The convex surface 272 is concentric to the axis of the drive shaft 162 and is just large enough to barely clear the smaller diameter convex surface 264 on the antirotation plate 262 for the primary drive shaft 252. Moreover, the length of the convex surface 272 for the plate 270 equals the length of the lesser diameter convex surface 264 on the plate 262. The concave surface 274, on the other hand, possesses the same radius as the larger diameter convex surface 266 on the plate 262 and is otherwise positioned to lie against and conform to the convex surface 266 of the plate 262 when the gap in the segmented gear 258 is presented toward the pinion 260.

Thus, while the segmented gear 258 is meshed with the pinion 260, the small diameter convex surface 264 that is adjacent to the former revolves close to the convex surface 272 that is adjacent to the latter. However, when the last tooth on the segmented gear 258 disengages the pinion 260, the concave surface 274 on the plate 270 that is adjacent to the pinion 260 passes over one of the transition surfaces 268 on the plate 262 that is adjacent to the segmented gear 258 and then lies adjacent to the larger diameter convex surface 266 on the plate 262. Indeed, the concave surface 274 on the plate 270 conforms precisely to the convex surface 266 on the plate 262, and by reason of this mating of the two plates 262 and 270, the plate 270 and the shaft 162 to which it is affixed cannot rotate, even though the adjoining plate 262 and the primary drive shaft 252 on which it is mounted continue to revolve. Both antirotation plates 262 and 270 are formed from hardened steel.

Behind the center plate 12, the primary drive shaft 252 also carries a cogged pulley 280 (FIGS. 3, 4 & 6) around which a timing belt 282 passes. This belt extends upwardly and also loops around another cogged pulley 284 (FIG. 14) carried by a tying head shaft 286 that rotates in bearings 288 on the center plate 12, the rear plate 16 and the upper front plate 20. The outer surface of the timing belt 282 rides over an idler wheel 290 (FIG. 6) which rotates on an adjustable mount 292 that is bolted to the back face of the center plate 12, and that wheel 290 maintains the timing belt 282 taut. The two cogged pulleys 280 and 284 are equal in diameter and thus possess an equal number of cogs, so that each time the clutch 256 is energized to impart precisely one revolution to the primary drive shaft 252, the tying head shaft 286 likewise undergoes precisely one revolution.

The tying head shaft 286 projects through the upper front plate 20 of the frame 4, and immediately beyond the front face of that plate it is fitted with a timing wheel 293 (FIG. 5) which moves past a timing mark inscribed on the plate 20. Indeed, the wheel 293 is marked in degrees, and when at rest between tying cycles, 0° is at the timing mark.

Figure 16:
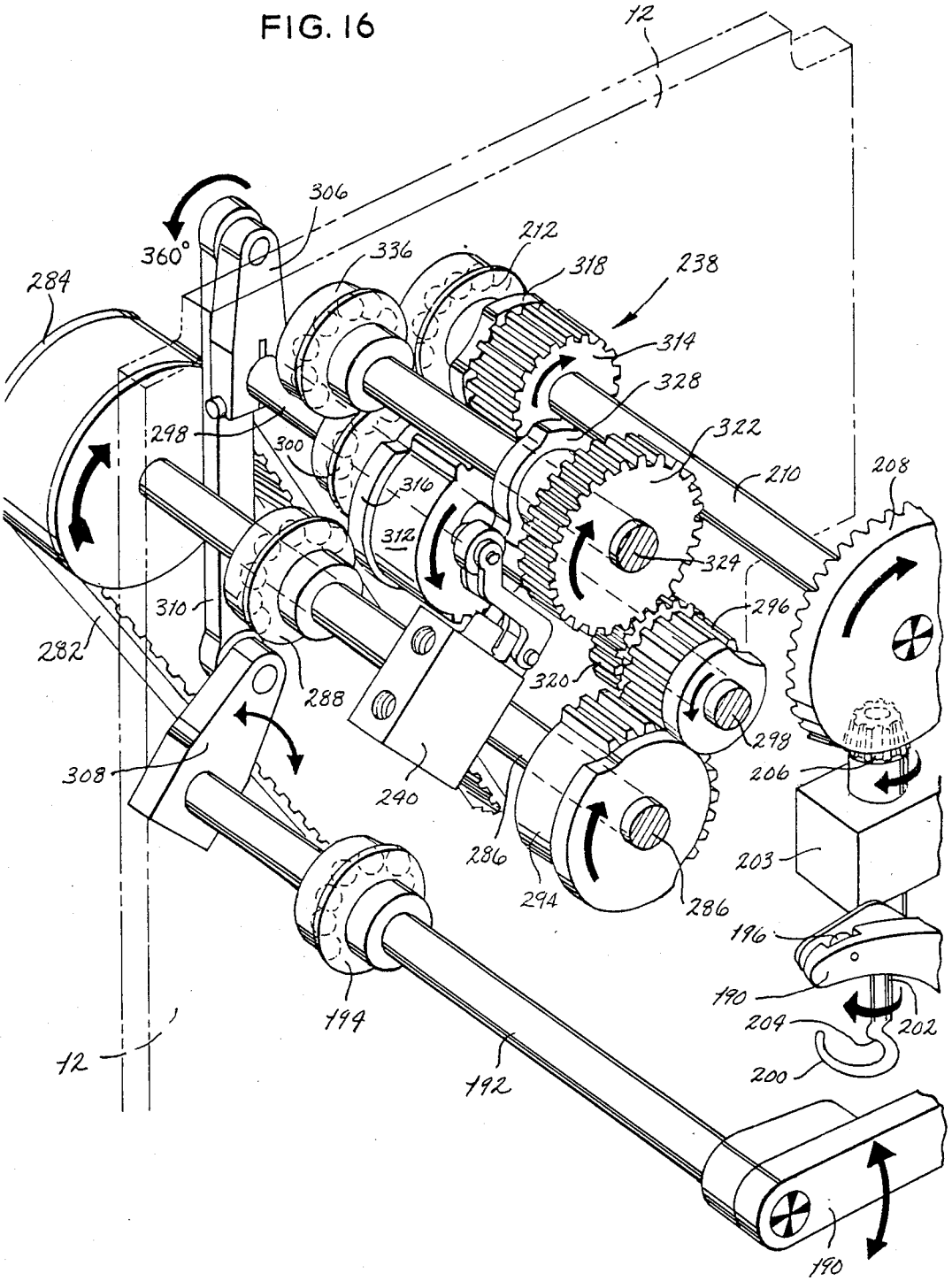
FIG. 16 is a fragmentary perspective view showing the various shafts and gears which comprise that portion of the drive train which is powered by the tying head shaft.

Immediately to the rear of the upper front plate 20 for the frame 4, the tying head shaft 286 is fitted with a segmented gear 294 (FIG. 16) which rotates adjacent to a pinion 296 on a countershaft 298 that extends between the upper front plate 20 and the center plate 12, it rotating in bearings 300 that are on the two plates 12 and 20. Preferably the segmented gear 294 has 18 teeth and the pinion has 20 - a combination which causes the pinion 296 and the countershaft 298 which carries it to undergo one revolution for every full revolution imparted to the tying head shaft 286, although the countershaft 298 rotates at a greater velocity than the tying head shaft 286. Moreover, the two shafts 286 and 298 are fitted with antirotation plates 302 and 304 which are adjacent to their respective gears 294 and 296. The two gears 294 and 296 together with their antirotation plates 302 and 304 function similar to the gears 258 and 260 and the antirotation plates 262 and 270 through which the endless chain 150 and its pusher tabs 168 are advanced By reason of the antirotation plates 302 and 304 the countershaft 298 is locked against rotation when the teeth of the segmented gear 294 are disengaged from the pinion 296. This condition exists at the beginning of any tying cycle, so that when the clutch 256 is energized, the countershaft 298 does not immediately begin to rotate, although the tying head shaft 286 does. Indeed, the pinion 296 does not begin to turn until the gap in the segmented gear 294 passes by the pinion 296 and the first tooth on the segmented gear 294 engages the pinion 296. This occurs as the teeth of the other segmented gear 258 run off of its pinion 260 and the antirotation plates 262 and 270 for those gears lock the sprocket shaft 162 against rotation, and this of course is when the chain 150 moves one of its pusher tabs 168 into the tying zone z.

Figure 6:
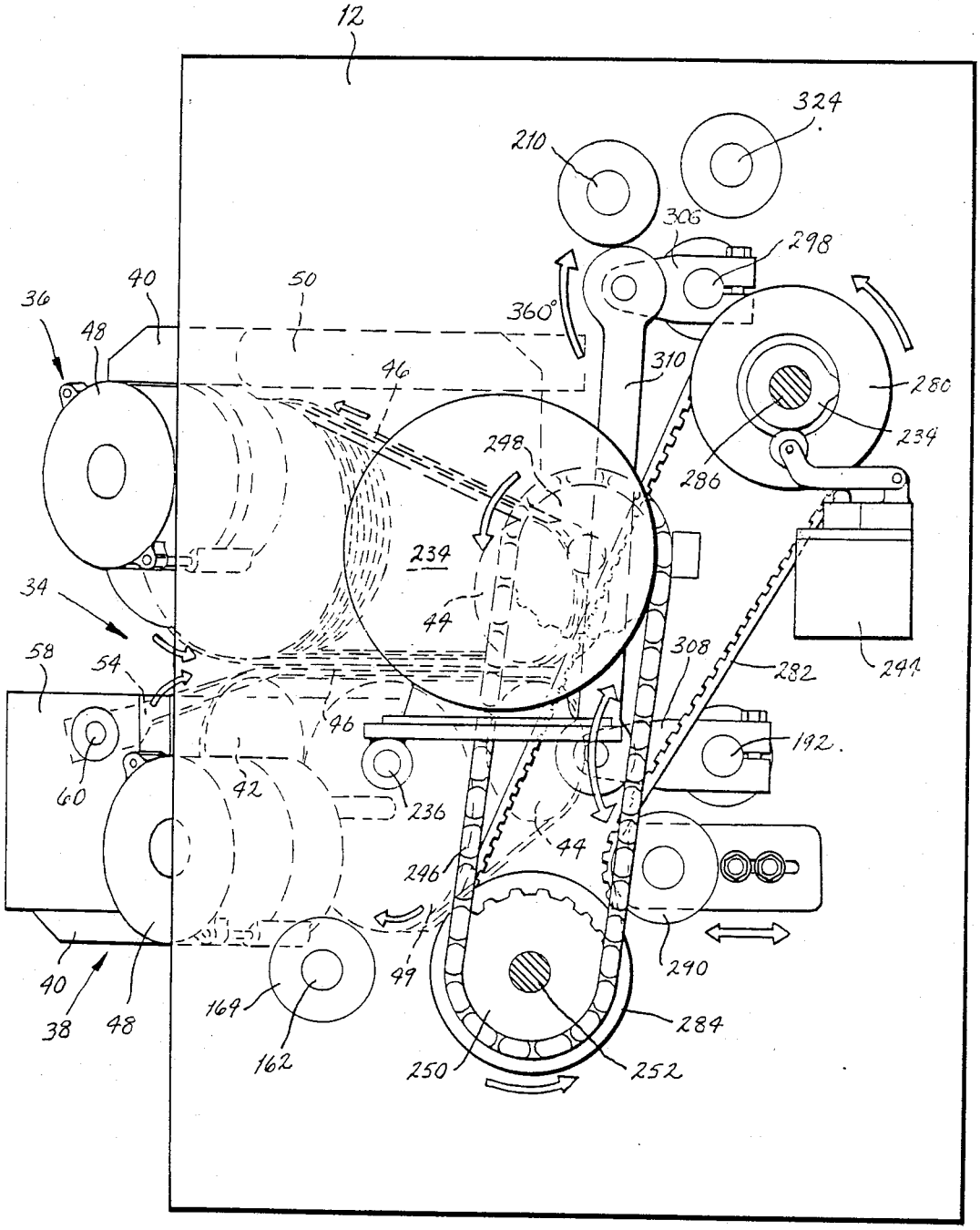
FIG. 6 is a rear sectional view of the machine taken along line 6—6 of FIG. 3.
Figure 7:
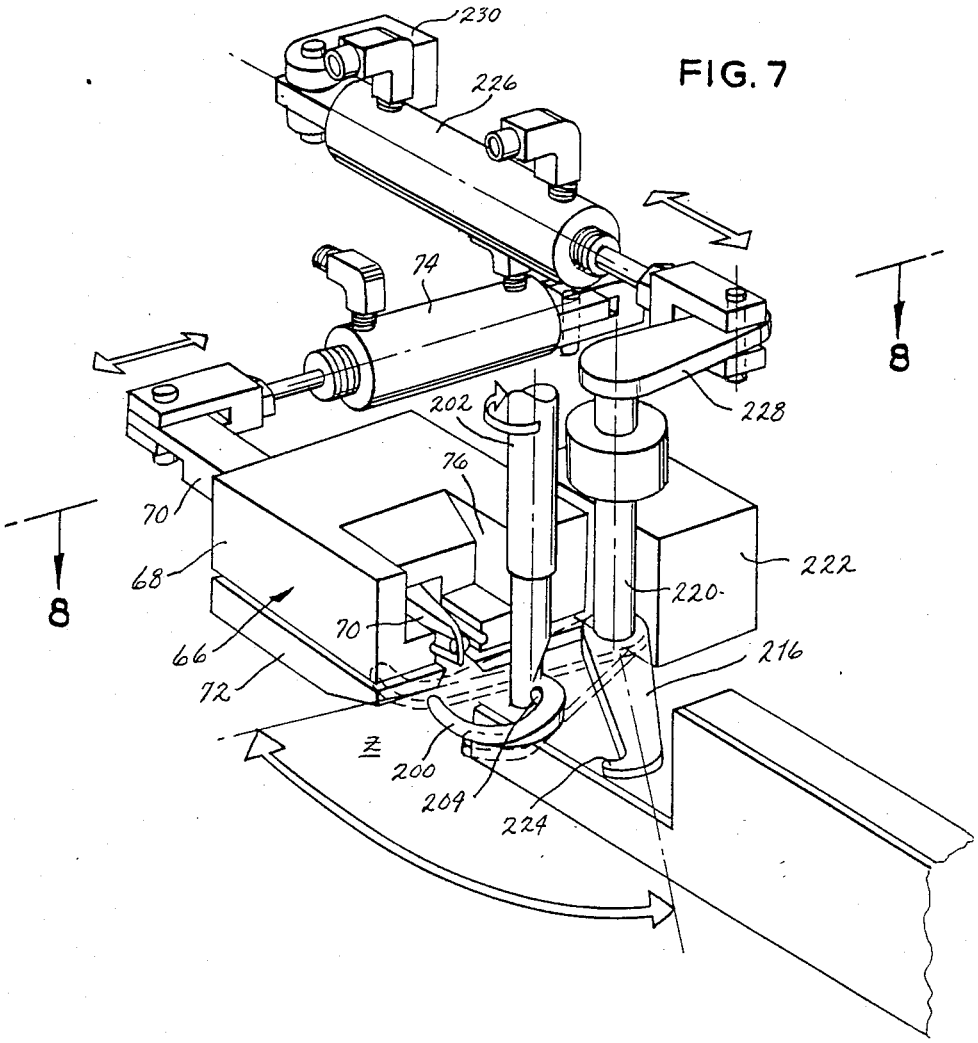
FIG. 7 is a perspective view showing the ribbon holder, the twister hook and the ribbon stripper.

The countershaft 298 projects rearwardly beyond the center plate 12 where it is fitted with a crank arm 306 (FIGS. 6 & 16), and when the countershaft 298 is at rest, that is when the antirotation plates 302 and 304 prevent its pinion 296 from turning, the crank arm 306 assumes a horizontal orientation (FIG. 6). Moreover, the countershaft 298 is located directly above the needle shaft 192 which also projects rearwardly beyond the center plate 12 where it too is fitted with a crank arm 308. The two crank arms 306 and 308 are tied together with a connecting link 310, the length of which is such that the crank arm 308 likewise assumes a horizontal orientation when the countershaft 298 is at rest. The needle shaft 192, which likewise forms part of the drive train 238, carries the ribbon needle 190, and when the two shafts 298 and 192 are at rest, the needle 190 is in its retracted position below guide rail 32 (FIG. 5*a*).

However, once the segmented gear 294 turns far enough to bring its teeth into engagement with teeth on the pinion 296, which is when the two antirotation plates 302 and 304 unlock, the segmented gear 294 turns the pinion 296 and the countershaft 298 at twice the velocity of the tying head shaft 286. The pinion 296 and countershaft 298 undergo precisely one revolution before the two antirotation plates 302 and 304 again lock up, and during this revolution the crank arm 306 moves upwardly over top dead center then downwardly to bottom dead center and then upwardly again to the starting horizontal position. This full revolution of the crank arm 306 is transmitted to the needle shaft 192 through the connecting link 310 and crank arm 308 and causes the needle shaft 192 to move the needle 190 out of its retracted position to its elevated position and then back to its retracted position (FIGS. 5*b, c, d*). This movement of the needle 192, which is generally harmonic in character, takes place while the other set of antirotation plates 262 and 270 lock the sprocket shaft 162 against rotation, which is while one of the pusher tabs 168 is at the tying zone z.

The countershaft 298 in turn carries a segmented gear 312 which rotates adjacent to a pinion 314 on the twister shaft 210, which along with the bevel gears 206 and 208 and the vertical shaft 202 driven by it, also constitute part of the drive train 238. Like the other sets of segmented gears and pinions, the segmented gear 312 preferably has 18 teeth and the pinion 314 has 20, so that the pinion 314 will rotate one revolution for every revolution of the segmented gear 314, but at twice the velocity. Moreover, the segmented gear 312 and pinion 314 are fitted with antirotation plates 316 and 318 which prevent the pinion 314 and twister shaft 210 from rotating when the teeth of the segmented gear 312 are disengaged from the pinion 314 This condition exists when needle shaft 192 moves the needle 190 toward its extended position and also as it moves it away from its extended position and, of course, while the needle 190 is in its retracted position.

However, as the needle 190 approaches its extended position (FIG. 5*c*), the countershaft 298 rotates the segmented gear 312 to the point that the antirotation plates 316 and 318 unlock and the teeth on it engage the teeth of the pinion 314. The needle 190, by reason of the harmonic motion imparted to it, dwells somewhat in its extended position, and during this dwell, the pinion 314 and twister shaft 210 rotate at twice the speed of the countershaft 298. The twister shaft 210 in turn rotates the vertical shaft 202 and the twister hook 200 that is on that vertical shaft 202, and indeed the twister hook 200 turns at four times the velocity of the twister shaft 210 due to the beveled gears 206 and 208 that couple the two shafts 202 and 210. Thus, while the needle 190 moves into its extended position, dwells there, and commences to move out of it, the twister hook 200 undergoes four quick revolutions, and during these four revolutions it twists the leading and trailing segments of ribbon r that are held in the tying zone z respectively by the ribbon holder 66 and the needle 190.

Next to its pinion 296, the countershaft 298 is fitted with another pinion 320 (FIG. 16) which meshes with a full gear 322 that is fitted to an idler shaft 324 which rotates in bearings 326 that are mounted in the center plate 12 and the upper front plate 20. The pinion 320 is one-half the size of the full gear 322, the former preferably having 24 teeth and the latter 48. Thus, for every revolution completed by the countershaft 298, and likewise by the tying head shaft 286 and the primary drive shaft 252, the idler shaft 324 undergoes one-half of a revolution. The idler shaft 324 carries a cam 328 which operates a follower on the four-way air valve 240 for the cylinder 74 of the ribbon holder 66. During one-half of a revolution the cam 328 depresses the follower for the valve 240 and during the other half allows the follower to extend, each transition occurring just as the ribbon needle 190 reaches top dead center which is its fully extended position. The air valve 240 is interposed between a source of compressed air and the double acting air cylinder 74 for the ribbon holder 66, and is constructed such that when its follower is depressed, compressed air is directed to one end of the cylinder 74, and when the follower is extended, compressed air is directed to the other end of the cylinder 74. Since the cylinder 74 operates the clamping bar 70, that bar clamps against one jaw 80 of the clamping slot 78 (FIG. 8*a*) during one-half of a revolution for the idler shaft 324 and against the other jaw 80 of the clamping slot 78 during the other one-half revolution (FIG. 8*b*), with the shift from one to the other being when the needle 190 is in its extended position at top dead center. Thus, the idler shaft 324 and the cam 328 on it make one-half a revolution for each full revolution of the primary drive shaft 252 and cause the clamping bar 70 to clamp the ribbon r against opposite jaws 80 of the clamping slot 78 during each succeeding revolution of the primary drive shaft 252. The angular position of the cam 328 on the shaft 324 is adjustable to precisely control the time at which the air cylinder 74 changes the position of the clamping bar 70.

Figure 2A:
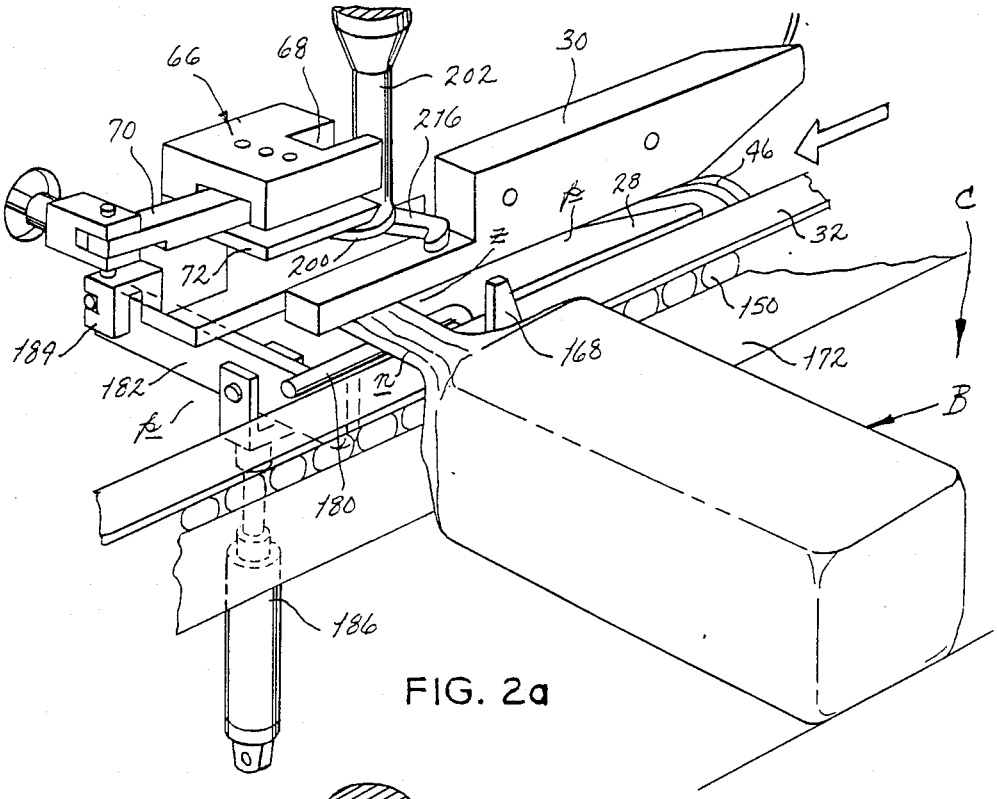
FIGS. 2*a* and *b* are fragmentary perspective views showing the portion of the machine containing the tying path and also a conveyor for advancing bagged products past the machine, with FIG. 2*a* illustrating the clamping bar of the machine in its retracted position and FIG. 2*b* illustrating the clamping bar in its elevated position in which it clamps the bag neck.
Figure 2B:
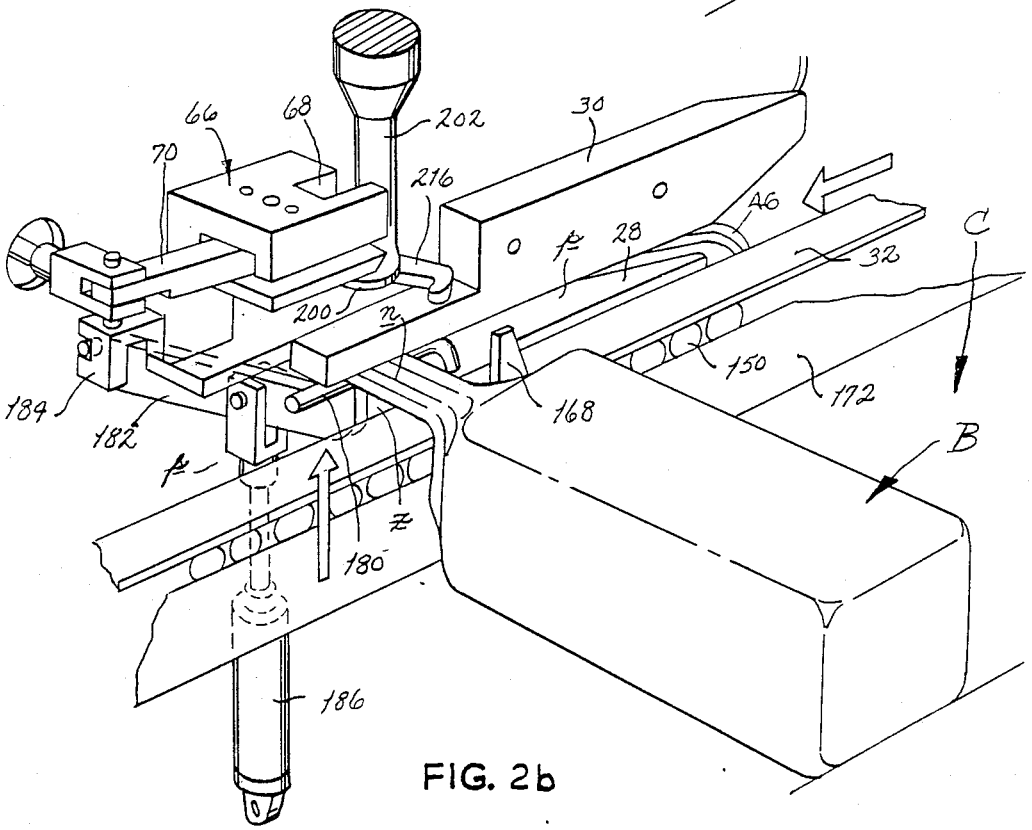
Figure 3:
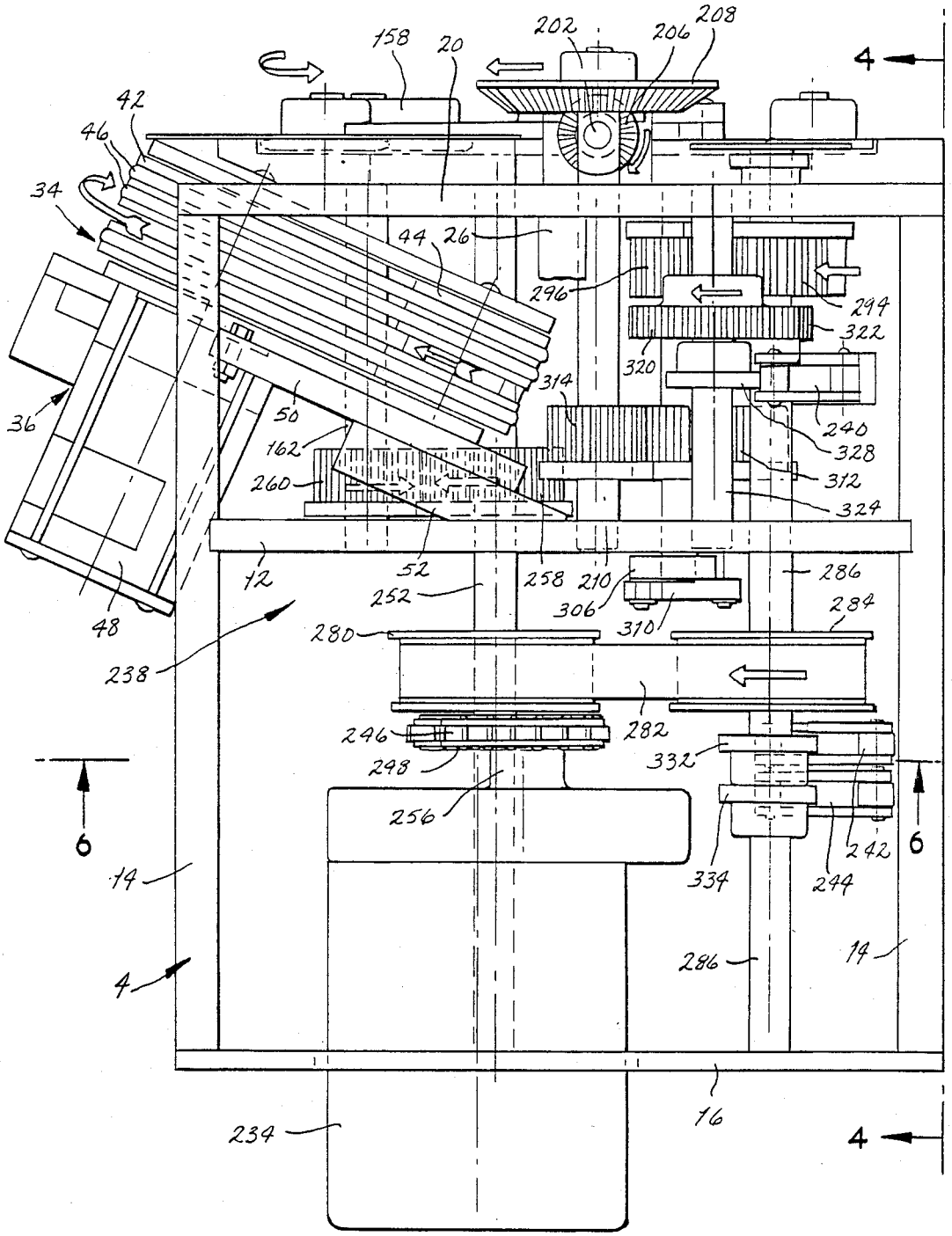
FIG. 3 is a sectional view of the machine in plan taken along line 3—3 of FIG. 1.
Figure 4:
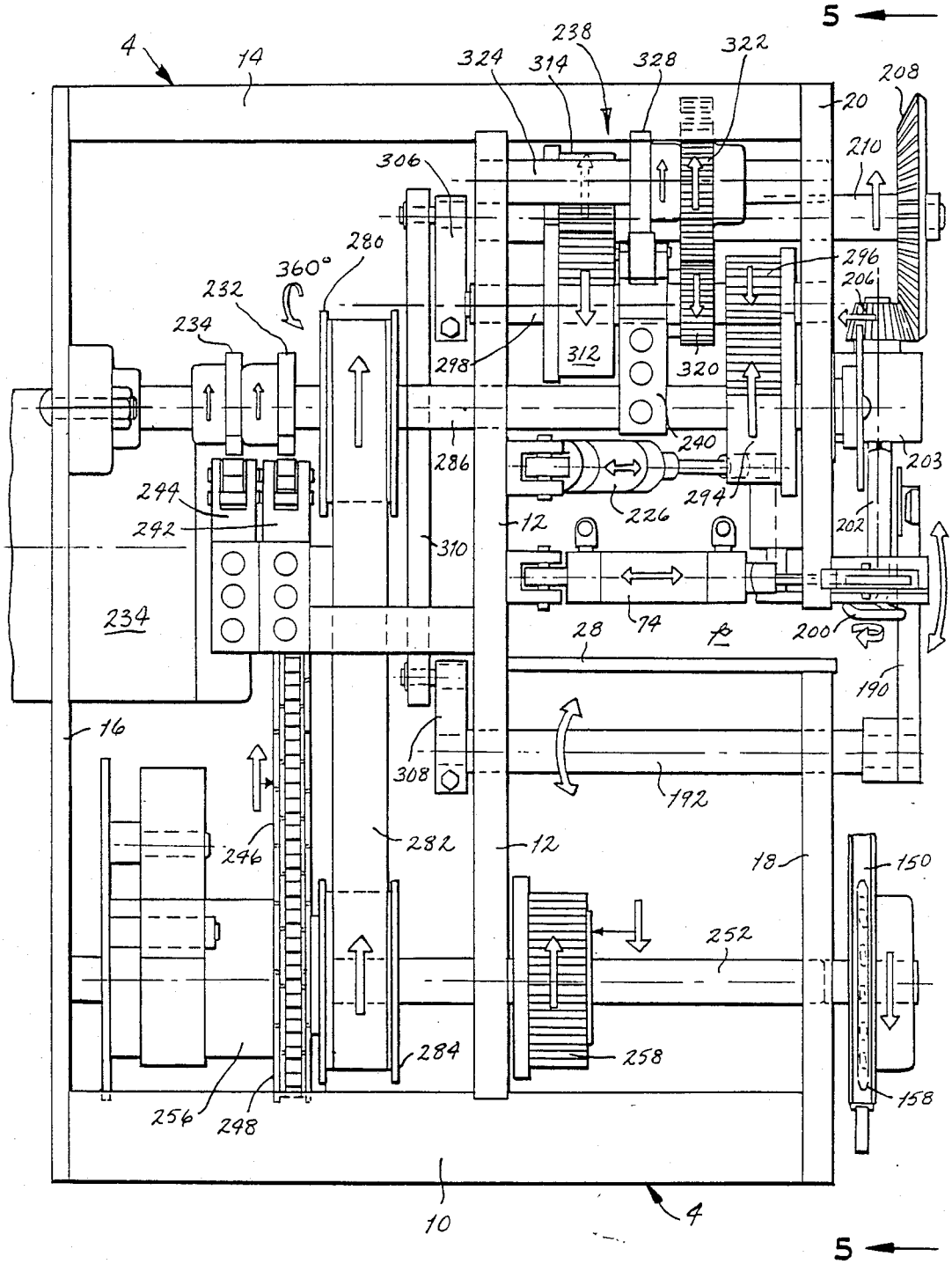
FIG. 4 is a sectional view in elevation taken along line 4—4 of FIG. 3.

The tying head shaft 286 extends all the way to rear plate 16 and in the region between the pulley 284 and the rear plate 16 it carries two cams 332 and 334 (FIGS. 3 & 4). The cam 332 operates a follower on the four-way air valve 242 through which compressed air is directed to the cylinder 186 of the bag neck clamp 180, while the cam 334 operates a follower on the four-way air valve 244 through which compressed air is directed to the cylinder 226 of the ribbon stripper 216. In this regard, the cam 332 is configured to pressurize the cylinder 186 such that it drives the bag neck clamp 180 up toward the underside of the upper bag guide 30 (FIG. 2*b*), just when the chain 150 stops moving momentarily as the gap in the segmented gear 258 passes by the pinion 260, which is of course when the chain 150 brings a pusher tab 168 up to the tying zone z. It is further configured to pressurize the cylinder 186 from its opposite end when or just before the twister hook 200 stops rotating, and this has the effect of retracting the bag neck clamp 180 (FIG. 2*a*). The cam 334, on the other hand, is configured to pressurize the cylinder 226 such that it swings the ribbon stripper 216 outwardly and along the path p beneath the twister hook 200 when the chain 150 commences moving after the dwell, which is just after the instant the bag neck clamp 180 releases. After the stripper 216 reaches its forwardmost position, the cam 334 changes the position of the follower for the valve 244 so that the stripper 216 moves back to its initial position. The two cams 332 and 334 may be adjusted angularly with respect to the tying head shaft 286 to control the operation of the air cylinder 186 which actuates the bag neck clamp 180 and the air cylinder 226 which actuates the ribbon stripper 216.

The cabinet 6 (FIG. 1) encases the frame 4 and the drive train 238 that is carried by it. It includes the side wall 8 on which the spindle 102 for the ribbon reel 100 and tension arm 110 are mounted. It also includes a lower front panel 342 which is attached to lower front plate 18 of the frame 4 such that it obscures the endless chain 150. The lower front panel 342 contains a slot 344 through which the ribbon r is threaded to place it over the needle 190 and the front roller 138. In addition the cabinet 6 includes an upper front panel 346 which covers the upper front plate 20 of the frame 4, it being hinged along its upper margin to the upper front plate 20. The upper panel 346 generally encloses the ribbon holder 66, the twister hook 200 and the bevel gears 206 and 208 which drive the twister hook 200. It also obscures the timing wheel 293.

OPERATION

To prepare the tying machine A for operation, a reel 100 of ribbon r is placed over the spindle 102, and a short length of ribbon r is withdrawn from it. This portion of ribbon r is looped under the tension roller 108 on the arm 110 and over the idler pulley 11 (FIG. 1). Beyond the idler pulley 112 it is passed around the corner roller 136 and thereafter threaded into the slot 344 in the lower front panel 342. The slot 344 configures the ribbon r such that it passes beneath the ribbon needle 190, behind the front roller 138 and over the roller 196 on the end of the ribbon needle 190 (FIG. 5*a*). The ribbon r is brought upwardly through the path p, looped downwardly, and fitted into the clamping slot 78 of the clamping block 68 that forms part of the ribbon holder 66 By manipulating manual controls, the air cylinder 74 for the ribbon holder 66 is energized to move the clamping bar 70 against ribbon r so that the ribbon r is clamped between the convex rib 90 on one side of the bar 70 and the corresponding groove 82 along the side of the clamping slot 78. Tracing the ribbon r backwardly from its free end where it is clamped by the bar 70, it comes out of the top of block 68 and immediately loops downwardly to pass obliquely through the path p to the roller 196 at the end of the ribbon needle 190. Beyond the needle roller 196 it loops around the front roller 138 and then under the needle 190 to the corner roller 136.

When a bag B containing a product, such as a loaf of bread, encounters the tying machine A in the proper orientation, as it would if it were transported past the machine A on the endless belt conveyor C (FIG. 2), the neck n of the bag B, while in a somewhat flattened and spread condition moves onto the platen 28 and enters the path p in the region of bag drive 34. Indeed, the bag neck n moves into the nip formed by the endless belts 46 of the upper and lower units 36 and 38 of the bag drive 34, so the belts 46 grip the bag neck n and quickly advance it to the tying zone z, pulling it laterally into the path p during the advancement. This causes the bag B to draw snugly over the product. As the bag neck n moves between the belts 46, it depresses the sensor arm 54 for the bag sensor 56, but once the trailing edge of the bag neck n passes over the arm 54, the arm 54 rises, causing the bag sensor 56 to produce a signal which commits the machine A to one tying cycle. The signal causes the clutch-brake 256 to engage the sprocket 250 with the primary drive shaft 252 so that the primary drive shaft 252 turns through precisely one revolution, whereupon the clutch-brake 256 locks the primary drive shaft 252 against further rotation. During this one revolution, a twist tie t is applied to the bag neck n. Since the timing belt 282 acting through the cogged pulleys 280 and 284 connects the tying head shaft 286 to the primary drive shaft 252 at a one-to-one ratio, the timing wheel 293, which is on the end of the tying head shaft 286, likewise rotates through precisely one revolution, and it may be used to track the operation of the chain 150, the needle 190, and twister hook 200, the ribbon holder 66, the bag clamp 180, and the ribbon stripper 216, all of which contribute to placement of a twist tie t around the bag neck n during the tying cycle - that is, during one revolution of the primary drive shaft 252.

At the commencement of the tying cycle, the timing mark on the upper front plate 20 is opposite the 0° mark on the timing wheel 293. In this condition the segmented gear 258 on the primary shaft 252 is engaged with the pinion 260 on the sprocket shaft 162, and one of the tabs 168 on the endless chain 150 of the bag pusher 148 is poised over the idler sprocket 154 immediately below the path p where it is free to swing backwardly, while another tab 168 is located beyond the path p over the sprocket 152, and still another is located midway between the idler sprocket 156 and the drive sprocket 158 (FIG. 5*a*). When the primary drive shaft 252 commences to rotate, the drive sprocket 158 rotates by reason of the engagement of the segmented gear 258 and pinion 260, and the chain 150 brings the poised pusher tab 168 up over the idler sprocket 154 and onto the track 172. Indeed, the shoe 176 on the tab 168 rides on the track 172 while the portion of the chain 150 along which it is captured between the guide rail 32 and the track 172. As a result, the chain 150 and track 172 hold the tab 168 in an upright or elevated position, preventing it from tilting rearwardly. The tab 168 comes behind that bag neck n which triggered the tying cycle and drives the bag neck n forwardly, causing it to gather still further behind the oblique section of ribbon r that extends upwardly through the path p. Indeed, the tab 168 drives the bag neck n forwardly to the extent that it deflects the ribbon r. When the rib 174 of the tab comes to about ⅜ inches from the axis of rotation for the twister hook 200, which is after about 100° of rotation for the timing wheel 293 (FIG. 5*b*), the last tooth on the segmented gear 258 passes off of the pinion 260 and the antirotation plates 262 and 270 lock the sprocket shaft 162 against further rotation. In short, the tab 168 comes to rest in the tying zone z with the bag neck n gathered between it and the section of ribbon r that passes between the ribbon holder 66 and the needle 190.

At the instant the chain 150 stops with its tab 168 in the tying zone z, that is at about 105 ° on the timing wheel 293, the cam 332 on the tying head shaft 286 actuates the air valve 242, causing it to energize the air cylinder 186 such that the cylinder 186 drives the bag neck clamp 180 upwardly to clamp the gathered bag neck n against the underside of the upper bag guide 30.

At about the same instant, that is at 105 ° on the timing wheel 293, teeth on the segmented gear 294 that is carried by the tying head shaft 286 engage the pinion 296 on the countershaft 298, causing the countershaft 298 to rotate. The segmented gear 294 remains engaged with the pinion 296 for another 180° of rotation of the timing wheel 293, and that is long enough to rotate the pinion 296 and its countershaft 298 through one revolution. During this revolution the countershaft 298, being coupled to the needle shaft 192 through the crank arms 306 and 308 and the connecting link 310, oscillates the needle shaft 192 such that the needle 190 on it moves out of its retracted position to its extended position (FIG. 5c) and then back to its retracted position (FIG. 5d) in a motion that approximates simple harmonic. As the needle 190 rises, its roller 196 carries the ribbon r upwardly behind the gathered bag neck n so that the ribbon r loops under the bag neck n and a segment of ribbon r exists ahead of the gathered bag neck n and another segment exists behind it (FIG. 5c). The bag neck clamp 180, which holds the gathered bag neck n against the underside of the upper bag guide 30, prevents the looped ribbon r from pulling the bag neck n upwardly into the twister hook 200. When the needle 190 reaches top dead center (FIG. 5c), that is its fully extended position, the feed roller 196 on the needle 190 is over the clamping block 68 of the ribbon holder 66, and indeed the trailing segment of ribbon r passes upwardly through the slot 78 in the block 68. As such, the trailing segment is located to one side of the clamping bar 70. At this point in the tying cycle, the timing wheel 293 is at about 195°.

As the ribbon needle 190 approaches top dead center, or more precisely at about 155° on the timing wheel 293, the first tooth on the segmented gear 312 that is carried by the countershaft 298 comes into engagement with the pinion 314 that is on the twister shaft 210, and the segmented gear 312 and pinion 314 remain engaged long enough for the former to impart one full revolution to the latter and to the twister shaft 210. By reason of the bevel gears 206 and 208, this single revolution translates into four full revolutions for the vertical shaft 202 and the twister hook 200 which it carries. During these revolutions, the twister hook 200 gathers the leading and trailing segments of the looped ribbon r and twists them together. The teeth of the segmented gear 312 run off of the pinion 314 as the needle 190 moves back to its retracted position, or more precisely when the timing wheel reaches about 275°, and at this time the antirotation plates 316 and 318 mate so as to lock the twister shaft 210 and the twister hook 200, as well, against further rotation.

Just as the needle 190 is at top dead center, which is when the timing wheel 293 is at about 195°, the idler shaft 324 carries its cam 328 to a position where it changes the air valve 240, causing that valve to admit air to the cylinder 74 of the ribbon holder 66 and thereby shift the clamping bar 70. The tapered end of the bar 70 moves through the clamping slot 78 and shears the trailing segment of the ribbon r as its lower edge crosses the cutting edge 94 of the shear plate 72, thus freeing the completed tie t and of course the bag neck n around which it is located. At about the same instant the rib 90 on that side of the clamping bar 70 which is presented toward the trailing segment of ribbon r drives the new end of the ribbon r into the facing concave groove 82 along the jaw 80 toward which the bar 70 moves so that the ribbon holder 66 grips the new end of the ribbon r.

During the final revolution of the twister hook 200, which ends at about 275° on the timing wheel 293, the cam 332 on the tying head shaft 286 again operates the air valve 242, and with this actuation the air cylinder 186 to which the valve 242 is connected, moves the bag neck clamp 180 to its retracted position below the path p.

When the timing wheel 293 reaches about 285°, the ribbon needle 190 is back in its home or retracted position, that return being marked by the disengagement of the segmented gear 294 for the tying head shaft 286 from the pinion 296 and by the mating of the antirotation plates 316 and 318 which prevent the needle shaft 192 from turning. At this instant, the leading teeth on the segmented gear 258 that is carried by the primary shaft 252 again engage the pinion 260 of the sprocket shaft 162 to rotate the drive sprocket 158. The chain 150 and the tabs 168 carried by it again move, and that tab 168 which is at the tying zone z drives the gathered and tied bag neck n forwardly to the end of the path p and the guide rail 32 along the path p. The tab 168 moves over the sprocket 152 far enough to be below the path p, whereupon the chain 150 stops. This marks the end of the tying cycle, and the timing wheel is again at 0 °.

Returning now to the instant that the pusher tab 168 moved out of the tying zone z, which was at about 255° for the timing wheel 293, the other cam 334 on the tying head shaft 286 at about that instant actuates the air valve 244 such that it admits air to the cylinder 226 for the ribbon stripper 216 so as to bring the stripper 216 forwardly simultaneously with the tab 168 on the chain 150. Whereas the tab 168 clears the gathered and tied bag neck n from the tying zone z, the stripper 216 clears the ends of the twist tie t from the ribbon holder 66. The cam 334 after about 40° of rotation again actuates the valve 244 to return the stripper 216 to its retracted or home position.

Once the timing wheel reaches 0°, the clutchbrake 256 disengages the sprocket 250 from the primary drive shaft 252 and indeed locks the drive shaft 252 so it does not rotate. In this condition, the chain 152 cannot move because the pinion 260 on the sprocket shaft 162 is engaged with the segmented gear 258. The needle 190 cannot move, because the antirotation plates 302 and 304 between its shaft 192 and the tying head shaft 286 are mated, and of course the tying head shaft 286 as always is tied to the primary shaft 252 through the timing belt 282. Similarly, the twister hook 200 will not turn because the antirotation plates 316 and 318 between its twister shaft 210 and the countershaft 298 are mated.

The next tying cycle contains an identical sequence of events, except for the fact that a different pusher tab 168 is used. Indeed, a single pusher tab 168 moves through the tying zone z only once every third tying cycle. Also, the clamping bar 70 during the subsequent cycle will shift to and clamp along the other jaw 80 of the clamping slot 78, and to effect this end the idler shaft 324 which controls the operation of the cylinder 74 for the bar 70 rotates precisely one-half a revolution for every full revolution of the primary drive shaft 252.

This invention is intended to cover all changes and modifications of the example of the invention herein chosen for purposes of the disclosure which do not constitute departures from the spirit and scope of the invention.

What is claimed is:

1. In a machine for applying a twist-type tie to a bag neck and including ribbon placement means for looping a twist-type ribbon around a gathered bag neck so that the ribbon has two segments which project away from the neck, and twister means for twisting the two segments together, an improved device for holding one segment of the ribbon as the ribbon placement means loops the ribbon around the neck and for severing the other segment as the tie is completed, said device comprising: spaced apart jaws; a clamping element movable generally between the jaws to clamp the ribbon alternately between one side of the element and one jaw and the other side of the element and the other jaw; drive means for moving the clamping element between the jaws; and a shear plate located below the jaws and having cutting edges positioned along the jaws such that the clamping element will move the ribbon across a cutting edge as it clamps the ribbon against a jaw so as to sever the ribbon, the shear plate during operation of the clamping element being in a fixed position with respect to the jaws, yet being spaced from the jaws so that a gap exists between the shear plate and the jaws in the region of the cutting edges on the shear plate.

2. The combination according to claim 1 wherein the jaws are on a block and the gap exists between the shear plate and the block.

3. The combination according to claim 2 wherein the shear plate is attached to and carried by the block.

4. The combination according to claim 1 wherein the clamping element pivots with respect to the jaws.

5. The combination according to claim 4 and further comprising a fluid actuated cylinder connected to the clamping element for moving it between the jaws.

6. A ribbon holder and shear unit for a machine for applying twist-type ties to bags, said unit comprising: a clamping block having a clamping slot and first and second jaws, with the jaws facing each other across the slot; a clamping element mounted in the slot for movement between the two jaws, so that the element can clamp the ribbon alternately against the first and second jaws; a shear plate located adjacent to the clamping block and having a cutout which aligns with the clamping slot in the clamping block, the shear plate being spaced from the block so that a gap exists between the plate and block, the shear plate having first and second cutting edges, with the edges being presented toward each other across the cutout, the first cutting edge being located along the first jaw and the second cutting edge being located along the second jaw, the cutting edges being located such that the clamping element passes over the first cutting edge as it moves toward the first jaw and passes over the second cutting edge as it moves toward the second jaw, whereby, the ribbon is severed as it is clamped along the first and second jaws.

7. The unit according to claim 6 wherein the first cutting edge is generally parallel to the first jaw and the second cutting edge is generally parallel to the second jaw.

8. The unit according to claim 2 and further comprising a pivot pin in the block; and wherein the clamping element pivots on the pin when moving between the first and second jaws.

9. The unit according to claim 6 wherein the spacing between the cutting edges is less than the spacing between the jaws, and the cutting edges are offset slightly with respect to the jaws so that the clamping element will drive the ribbon across a cutting edge before clamping it against the jaw along which the cutting edge lies.

10. The unit according to claim 9 wherein the cutting element moves across the first cutting edge as it approaches the first jaw and across the second cutting edge as it approaches the second jaw.

11. The unit according to claim 10 wherein the jaws are provided with grooves and the clamping element is provided with ribs which align with and enter the grooves.

12. In a machine for deriving from a ribbon, which extends through a path, a twist-type tie for securing the end of a bag neck in a gathered condition, the machine including a bag drive for directing the neck against the ribbon where it extends through the path, a needle for elevating a portion of the ribbon behind the gathered bag neck so that the ribbon has leading and trailing segments and twist means for twisting the leading and trailing segments together, a holder and shear unit for securing the ribbon at the end of its leading segment and for severing the trailing segment to free the twist tie which is formed from the leading and trailing segments, said holder and shear unit comprising: a clamping block mounted over the path and having a clamping slot at which the leading segment of the ribbon is secured and into which the needle places the trailing segment, the block having jaws which are present toward each other across the slot; a clamping element movable through the slot from one jaw to the other for clamping the end of the ribbon against one of the jaws, the clamping element at the slot being narrower than the slot so that the needle can place the trailing segment of the ribbon between the clamping element and one of the jaws; a fluid operated cylinder connected to the clamping element for moving the element through the slot from one jaw to the other jaw and back again; and a shear plate located below the block and having a cutout aligned with the slot of the block and also having first and second cutting edges which are presented toward each other across the cutout, the first cutting edge being located along the first jaw and the second cutting edge along the second jaw, with the first cutting edge being offset slightly with respect to the first jaw and the second cutting edge being offset slightly with respect to the second jaw, such that the clamping element will force the ribbon into the first cutting edge and sever it as the element moves toward the first jaw and will force the ribbon into the second cutting edge and sever it as the element moves toward the second jaw.

13. The combination according to claim 12 wherein the element moves across the first cutting edge as it moves toward the first jaw and across the second cutting edge as it moves toward the second jaw.

14. The combination according to claim 13 wherein a gap exists between the shear plate and the block.

15. The combination according to claim 14 wherein the block contains a pivot pin and the clamping element pivots on the pin as it moves between the jaws.

16. THe unit according to claim 8, wherein the pivot pin does not project below the shear plate.

17. The combination according to claim 1 and further comprising a pivot pin in the block; and wherein the clamping element pivots on the pin when moving between the first and second jaws, the pin having a head which does not project below the shear plate.

18. The combination according to claim 1 wherein the spacing between the cutting edges of the shear plate is less than the spacing between the jaws, and the cutting edges are offset slightly with respect to the jaws so that the clamping element will drive the ribbon across a cutting edge before clamping it against the jaw along which the cutting edge lies.

19. The combination according to claim 18 wherein the cutting element moves across the first cutting edge as it approaches the first jaw and across the second cutting edge as it approaches the second jaw.

20. The combination according to claim 3 wherein the cutting element is captured between the block and the shear plate for a substantial portion of its length.

21. The unit according to claim 6 wherein the clamping element is captured for a substantial portion of its length between the clamping block and the shear plate.

22. The combination according to claim 12 wherein clamping element is captured for a substantial portion of its length between the clamping block and the shear plate.

* * * * *

UNITED STATES PATENT AND TRADEMARK OFFICE

CERTIFICATE OF CORRECTION

PATENT NO. : 4,907,392

DATED : Mar. 13, 1990

INVENTOR(S) : David S. Knudsen, St. Louis, Mo.

It is certified that error appears in the above-identified patent and that said Letters Patent is hereby corrected as shown below:

Column 10, line 26 - after second "the" and before "bag" delete "("

Column 10, line 54 - delete word "constitute" and insert "constitutes"

Column 15, line 56 - After "drive" and before "train" delete "("

Column 20, line 8 - delete "mounted in" and insert "mounted on"

Column 21, line 32 - delete "idler pulley 11" and insert "idler pulley 112"

Column 25 - Claim 8 - line 60 - delete "claim 2" and insert "claim 7"

Signed and Sealed this

Seventh Day of May, 1991

*Attest:*

*Attesting Officer*

HARRY F. MANBECK, JR.

*Commissioner of Patents and Trademarks*